US007244539B2

(12) United States Patent
Baba et al.

(10) Patent No.: US 7,244,539 B2
(45) Date of Patent: Jul. 17, 2007

(54) MAGNETIC CARRIER AND TWO-COMPONENT DEVELOPER

(75) Inventors: Yoshinobu Baba, Kanagawa (JP); Ryoichi Fujita, Tokyo (JP); Takaaki Kaya, Shizuoka (JP); Kazuo Terauchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 321 days.

(21) Appl. No.: 10/834,073

(22) Filed: Apr. 29, 2004

(65) Prior Publication Data

US 2004/0253529 A1 Dec. 16, 2004

(30) Foreign Application Priority Data

May 14, 2003 (JP) ..... 2003-135274

(51) Int. Cl.
*G03G 9/113* (2006.01)

(52) U.S. Cl. ..... 430/111.35; 430/111.4; 430/111.41

(58) Field of Classification Search ..... 430/111.35, 430/111.4, 111.41
See application file for complete search history.

(56) References Cited

U.S. PATENT DOCUMENTS

| | | | | |
|---|---|---|---|---|
| 4,388,396 | A * | 6/1983 | Nishibayashi et al. | 430/126 |
| 5,494,770 | A | 2/1996 | Baba et al. | 430/122 |
| 5,573,880 | A | 11/1996 | Mayama et al. | 430/106.6 |
| 5,576,133 | A | 11/1996 | Baba et al. | 430/106.6 |
| 5,670,288 | A | 9/1997 | Okado et al. | 430/122 |
| 5,821,023 | A | 10/1998 | Shibuya et al. | 430/108 |
| 6,124,067 | A | 9/2000 | Mikuriya et al. | 430/106.6 |
| 6,165,663 | A | 12/2000 | Baba et al. | 430/106.6 |
| 6,171,747 | B1 * | 1/2001 | Sugizaki et al. | 430/126 |
| 6,447,972 | B1 * | 9/2002 | Nakajima et al. | 430/111.35 |
| 2003/0224279 | A1 * | 12/2003 | Kotsugai et al. | 430/111.35 |

FOREIGN PATENT DOCUMENTS

| | | |
|---|---|---|
| EP | 0 248 421 A2 | 12/1987 |
| EP | 0 513 578 A1 | 11/1992 |
| EP | 0 800 118 A1 | 10/1997 |
| EP | 0 999 478 A1 | 5/2000 |
| JP | 09-281807 | 10/1997 |
| JP | 10-307429 | 11/1998 |
| JP | 00-39740 | 2/2000 |
| JP | 3173374 | 6/2001 |

* cited by examiner

*Primary Examiner*—Christopher RoDee
(74) *Attorney, Agent, or Firm*—Fitzpatrick, Cella, Harper & Scinto

(57) ABSTRACT

A magnetic carrier includes a magnetic material-dispersed resin core containing at least a magnetic material and a binder resin. The surface of the magnetic material-dispersed resin core is coated with a coating material containing at least a fluorine resin and 1 to 40 parts by weight of fine particles based on 100 parts by weight of the fluorine resin. The coating material is in an amount of 0.3 to 4.0 parts by weight based on 100 parts by weight of the magnetic material-dispersed resin core. The magnetic carrier has a contact angle of 95 to 125°. A two-component developer is also provided which makes use of the magnetic carrier.

13 Claims, 2 Drawing Sheets

MAGNETIC CARRIER AND TWO-COMPONENT DEVELOPER

BACKGROUND OF THE INVENTION

1. Field of the Invention

The present invention relates to a magnetic carrier and a two-component developer, which are used in electrophotography, electrostatic recording, and electrostatic printing.

2. Related Background Art

Conventionally, in an image-forming apparatus using electrophotography, such as a printer or a copying machine, a two-component developer containing toner and a magnetic carrier has been suitably used from the viewpoints of image quality, durability, and high-speed response ability. The following developing method has been used as a developing method making use of such a two-component developer in order to ensure a sufficient image density and enhance fine-line reproducibility. The method includes: bringing a magnetic brush of the developer into contact with a photosensitive member; making the peripheral speed of a developing sleeve faster than that of the photosensitive member; and superimposing an alternating electric field and a direct-current electric field on each other.

A magnetic carrier used in such a contact two-component developing method is one prepared by coating the surfaces of core particles of ferrite, magnetite, or the like with an insulative resin. This is because the magnetic carrier is provided with voltage tightness to some extent or more with respect to the applied electric field. However, the magnetic carrier coated with the insulative resin is being insulated. Therefore, the carrier cannot act as a developing electrode at the time of development. As a result, the carrier may cause an image defect such as a so-called blank area having an edge effect between halftone and solid black.

For alleviating the image defect and stabilizing the electrification to toner over a long period of time, Japanese Patent Application Laid-Open No. H10-307429 proposes a magnetic carrier prepared by dispersing fine resin particles containing conductive powders in a coating resin. In addition, Japanese Patent No. 3173374 proposes a magnetic carrier prepared by dispersing both resin fine particles and a conductive material in a resin having a critical surface tension of 35 dyne/cm or less as a coating material.

Although those magnetic carriers are capable of suppressing an image defect and also preventing the contamination (soiling with spent toner) of their surfaces, ferrite particles are used as core particles of the magnetic carriers, so that a developer magnetic brush will easily cause unevenness in sweeping in contact two-component development. In this case, furthermore, toner can be degraded by the stress to the toner at the time of continuing low-consumption printing, so that a problem of making the separation of toner from a magnetic carrier worse may occur.

Japanese Patent Application Laid-Open No. H9-281807 proposes to use a magnetic material-dispersed type carrier with lowered magnetic force and increased resistance. In addition, Japanese Patent Application Laid-Open No. 2000-039740 proposes to prevent the generation of spent toner by coating the surface of a magnetic material-dispersed type carrier with a resin having an aminosilane-coupling agent and a unit such as a fluoroalkyl unit or a methylene unit.

In those methods, the specific resistance of a carrier is high, and a developing sleeve and a photosensitive member are rotated in their reverse directions to prevent the carrier having a comparatively low magnetic force from generating an image defect such as a blank area, thereby providing the carrier with a high image density and excellent dot reproducibility and alleviating the contamination of the carrier. However, when a process speed is accelerated, an increase in sliding friction force of the developer magnetic brush to the photosensitive member occurs at a developing area, so that the developer may be deteriorated. The method for development by rotating a developing sleeve and a photosensitive member in their reverse directions may cause unevenness in sweeping (hereinafter, referred to as scavenging effect) due to the sliding friction force of the magnetic brush, particularly at higher process speeds, compared with the method for development by rotating both the developing sleeve and the photosensitive member in their forward directions. In addition, the amount of development (image density) and a change in amount of development with the gradation of electric potential (gamma curve) tend to be altered by variations in distance between the developing sleeve and the photosensitive member, strength of an alternating electric field, amount of the developer carried on the developing sleeve, and so on.

SUMMARY OF THE INVENTION

An object of the present invention is to provide a magnetic carrier and two-component developer that have solved the above problems.

In other words, an object of the present invention is to provide a magnetic carrier and two-component developer, which allow excellent dot reproducibility at high image density without any image defect such as a blank area even in a method in which development is carried out by rotating a developing sleeve and a photosensitive member in their forward directions.

A further object of the present invention is to provide a magnetic carrier and two-component developer, which allow the output of an image with an image density stable for a long period of time even at the time of low-consumption printing.

The present invention provides a magnetic carrier including carrier particles, wherein each carrier particle includes a carrier core and a coating material for coating the carrier core, the carrier core includes a binder resin and magnetic particles dispersed in the binder resin, the coating material includes at least 100 parts by weight of a fluorine resin and 1 to 40 parts by weight of fine particles, the carrier includes at least 100 parts by weight of the carrier core and 0.3 to 4.0 parts by weight of the coating material, and a contact angle of the magnetic carrier is 95 to 125°.

Further, the present invention provides a two component developer, including toner and magnetic carrier, wherein the toner includes toner particles and an external additive, the toner particles contain at least a binder resin, a release agent, and a colorant, and an agglomeration of the toner is 20 to 90, the magnetic carrier includes carrier particles, each carrier particle includes a carrier core and a coating material for coating the carrier core, the carrier core includes a binder resin and magnetic particles dispersed in the binder resin, the coating material includes at least 100 parts by weight of a fluorine resin and 1 to 40 parts by weight of fine particles, the carrier includes at least 100 parts by weight of the carrier core and 0.3 to 4.0 parts by weight of the coating material, and a contact angle of the magnetic carrier is 95 to 125°.

The present invention is able to provide a magnetic carrier and two-component developer, which allow excellent dot reproducibility at high image density without any image defect such as a blank area even in a method in which development is carried out by rotating a developing sleeve and a photosensitive member in their forward directions.

In addition, the magnetic carrier and two-component developer of the present invention are able to output an image with an image density stable for a long period of time even at the time of low-consumption printing.

BRIEF DESCRIPTION OF THE DRAWINGS

FIGS. 2-1, 2-2, 2-3 are diagrams for explaining a blank area, and FIG. 2-1 is an enlarged view of an image in which the blank area is generated, FIG. 2-2 is a schematic cross-sectional view of a toner layer which forms such an image, and FIG. 2-3 is a schematic view of a toner layer which forms an image without a blank area.

DETAILED DESCRIPTION OF THE INVENTION

The inventors of the present invention have controlled the surface irregularity and release characteristics of a magnetic carrier by coating the surface of a magnetic material-dispersed type resin core with a coating material containing a fluorine resin having high release characteristics to toner and fine particles each having a particle size equal to or more than a certain value dispersed in the fluorine resin. Thereby, the toner separation at the time of development is alleviated and also any image defect such as a blank area can be alleviated in a method for development by rotating a developing sleeve and a photosensitive member in their forward directions even when a magnetic carrier is of high resistance.

Figure 1:
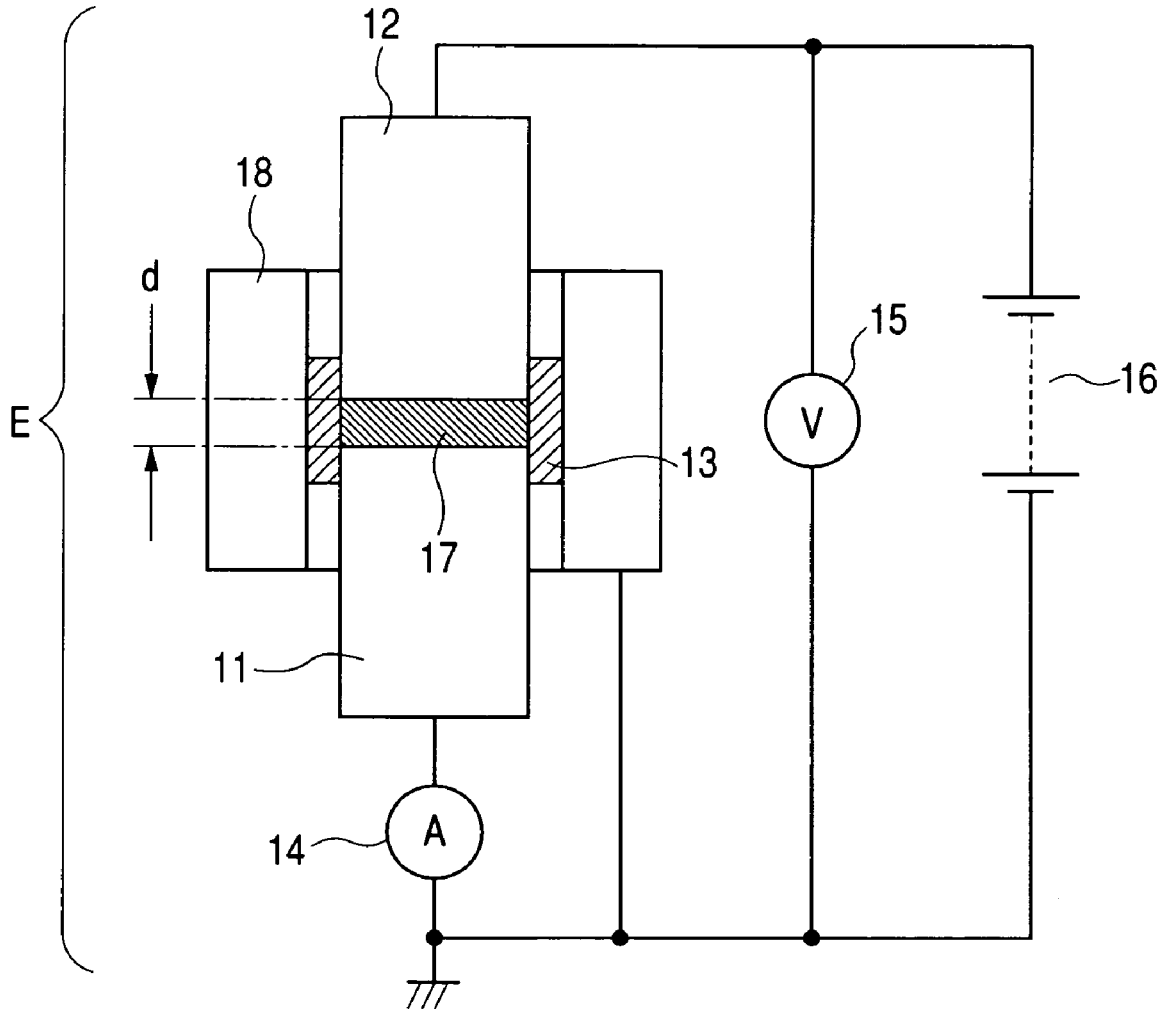
FIG. 1 is a schematic cross-sectional diagram of an apparatus for measuring the specific resistance of each of the magnetic carrier of the present invention, a magnetic material, and a non-magnetic inorganic compound.
Figures 1, 2:
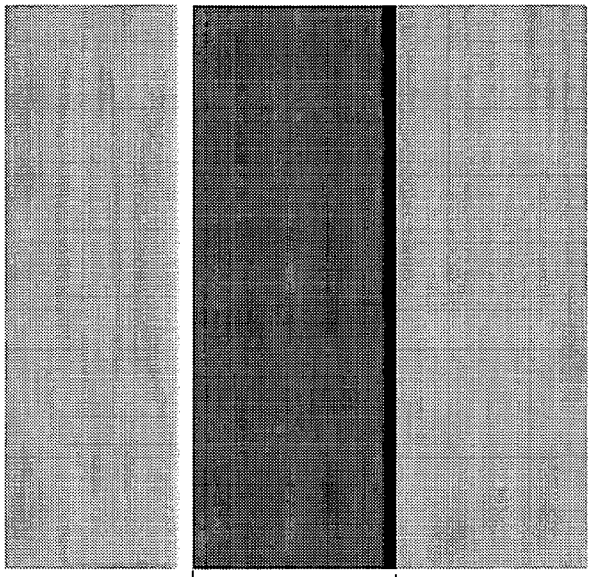
Figure 2:
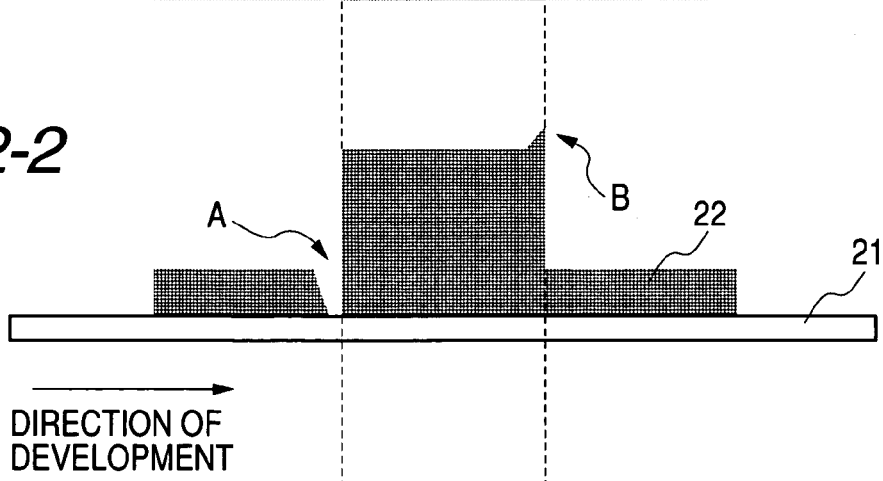
Figures 2, 3:
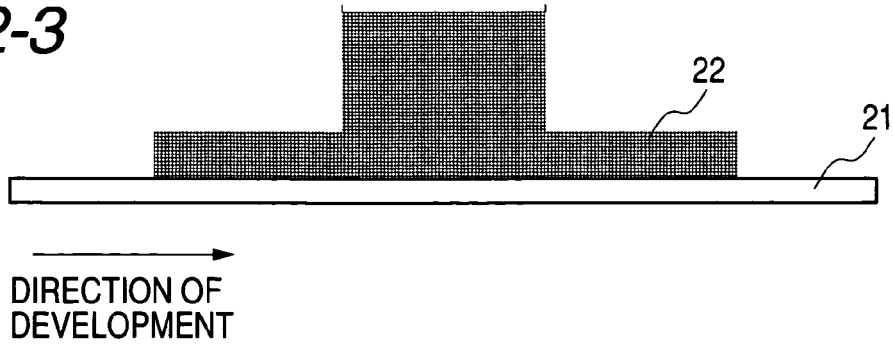

Referring now to FIGS. 2-1, 2-2 and 2-3, the blank area will be explained. FIG. 2-1 is an enlarged view of an image in which a blank area is actually generated, FIG. 2-2 is a schematic cross-sectional view of a toner layer which forms such image at that time, and FIG. 2-3 is a schematic view of an image in an ideal situation (i.e., in a state of no blank area). Furthermore, FIG. 2-1 shows an image formed such that the development is carried out of a halftone portion, a solid black portion, and a halftone portion in this order from the left side on the figure by a method for development in which a developing sleeve and a photosensitive member are rotated in their forward directions at a developing area. A whitened portion between the halftone portion on the left side and the solid black portion is referred to as a "blank area" in the present invention. FIG. 2-2 schematically represents the cross section of the image when viewed from the side thereof. In the figure, reference numeral 21 denotes a sheet of transfer paper and reference numeral 22 denotes the cross section of a toner layer. In FIG. 2-2, the alphabetical letter A denotes a blank area. There is no toner layer on the boundary between the halftone portion and the solid portion. In addition, the so-called "edge concentration" phenomenon by which the toner layer portion is raised (indicated by the arrow B in FIG. 2-2), which is located on the boundary between the solid black portion and the halftone portion where the subsequent development will be carried out. Both the phenomena "blank area" and "edge concentration" occur in the same mechanism, so that such a mechanism will be described in detail with reference to only the blank area.

Any image defect such as a blank area is caused by surrounding a photosensitive member with the electric lines of force from a developing sleeve at a developing pole. When the resistance of a magnetic carrier is low to some extent, the magnetic carrier serves as an electrode and is then in the state where an electrode is apparently placed close to a photosensitive member pole. Therefore, the photosensitive member can be prevented from being surrounded with the electric lines of force, so that an edge effect will not appear easily. However, if the magnetic carrier has high resistance, an electric field is applied to a gap (several hundred μm) between the photosensitive member and the developing sleeve. Thus, the electric lines of force swell centering around the portion nearest to the gap. Therefore, on the posterior end of a developing nip portion (the portion where the developer is in contact with the photosensitive member), after the toner is allowed to fly from the magnetic carrier by development, counter charges on the surface of the magnetic carrier remain in place. When the magnetic carrier has high resistance, the counter charges may pull the developed toner back to generate a blank area. Therefore, the generation of such a blank area can be eliminated by lowering the resistance of the magnetic carrier to prevent the photosensitive member as much as possible from being surrounded with the electric lines of force for allowing the carrier to act as an electrode and for allowing the remaining charges on the surface of the magnetic carrier after development to leak. However, a latent image is disturbed by allowing the photosensitive member to be subjected to sliding friction, and thus the halftone portion may be roughened. In addition, it is revealed that the toner is not pulled back as the magnetic carrier after development instantaneously moves away from the developing area in the case of carrying out development when the developing sleeve and the photosensitive member are rotated in their reverse directions even though the high-resistance magnetic carrier is used. However, scavenging may be caused by the magnetic brush as a result of an excess increase in peripheral speed difference to the photosensitive member.

Furthermore, it is found that development with a sufficient amount of toner with respect to a latent-image potential is effective to prevent the generation of a blank area. This is probably because the photosensitive member is hardly surrounded with the electric lines of force by eliminating the potential difference between the halftone portion and the solid image portion. In the case of using a magnetic carrier having a magnetic material-dispersed resin core, of importance is developability that sufficiently satisfies a latent-image potential in the development in the forward direction. Therefore, a fluorine resin having particularly high release characteristics is used for the magnetic carrier, and the surface of the carrier is provided with irregularity to sufficiently separate the toner and the magnetic carrier to thereby substantially alleviate the blank area. Thus, a high-quality image can be obtained while scavenging effect is prevented without disturbing the latent image on the photosensitive member.

The magnetic carriers of the present invention are preferably those having an average particle diameter of 10 to 80 μm in the particle diameter distribution on the basis of the number of the magnetic carriers. When the magnetic carriers have an average particle diameter of less than 10 μm, the adhesion of the carriers to the toner may easily occur. When the magnetic carriers have an average particle diameter of more than 80 μm, the specific surface area to the toner may be small, so that excellent electrification will not be provided. In particular, for making the high quality of an image and preventing the adhesion of the carriers, the magnetic carriers have an average particle diameter preferably in the range of 15 to 60 μm, further preferably in the range of 20 to 45 μm.

The magnetic carrier of the present invention has an intensity of magnetization ($\sigma_{1000}$) as measured in a magnetic field of $1{,}000\times(10^3/4\Pi)\cdot A/m$ (1,000 Oe) of preferably 15 to 65 $Am^2/kg$ (emu/g), more preferably 20 to 50 $Am^2/kg$. If the intensity of magnetization ($\sigma_{1000}$) exceeds 65 $Am^2/kg$, the toner is deteriorated by an increase in stress to the toner in the developer magnetic brush and the carrier is liable to be soiled with spent toner in some cases. In addition, if the intensity of magnetization ($\sigma_{1000}$) is less than 15 $Am^2/kg$, the magnetic binding force to the sleeve may be lost to cause a defect in an image by magnetic carrier adhesion and the adhesion on the surface of the photosensitive member.

The magnetic carrier of the present invention has a true specific gravity of preferably 2.5 to 4.0 $g/cm^3$, more preferably 3.0 to 3.8 $g/cm^3$. The true specific gravity of the magnetic carrier is preferably in the above range because a load to be applied to the toner at the time of mixing the magnetic resin carrier and the toner by stirring is low, so that spent toner is prevented from soiling the magnetic carrier and the adhesion of the magnetic carrier to the photosensitive member is also prevented.

The magnetic carrier of the present invention has a specific resistance of preferably $1\times10^{10}$ to $1\times10^{14}$ Ω·cm. If the specific resistance is less than $1\times10^{10}$ Ω·cm, halftone reproducibility decreases as the latent image of a micro dot is disrupted even though the generation of a blank area can be alleviated. In addition, if the specific resistance exceeds $1\times10^{14}$ Ω·cm, any image defect such as an edge effect may occur in a method for development in the forward direction even though the toner separation from the surface of the magnetic carrier is improved as greatly as possible.

The magnetic carrier of the present invention has a contact angle of 95 to 125°, preferably 105 to 125°. If the contact angle of the magnetic carrier is less than 95°, it becomes impossible to attain sufficient toner separation only by the surface irregularity and a blank area may occur. If the contact angle exceeds 125°, the generation of a blank area can be alleviated and the developability can be also increased, while the toner scattering occurs by rotating the developing sleeve at a high speed, contaminating the inside of the apparatus.

Specific examples of fluorine resins, which can be used for the formation of a coating material used in the magnetic carrier of the present invention, include: perfluoro polymers such as polyvinyl fluoride, polyvinylidene fluoride, polytrifluoroethylene, and polyfluorochloroethylene; copolymers of acrylic monomers with polytetrafluoroethylene, polyperfluoropropylene, and vinylidene fluoride; a copolymer of vinylidene chloride and trifluorochloroethylene; a copolymer of tetrafluoroethylene and hexafluoropropylene; a copolymer of vinyl fluoride and vinylidene fluoride; and a copolymer of vinylidene fluoride and tetrafluoroethylene. In particular, the fluorine resin that forms a coating material preferably used in the present invention is a polymer or copolymer having methacrylate ester unit or acrylate ester unit having a perfluoroalkyl unit represented by the following formula (1).

$$CF_3\text{-}(CF_2)_m \tag{1}$$

(In the formula, m represents any integer of 1 to 10.)

The resins described above may be used independently or in combination with each other. Furthermore, a product obtained by mixing a setting agent or the like in a thermoplastic resin and then hardening the mixture may be also used.

In the present invention, when m represents the integer 0 (zero), the contact angle of the magnetic carrier as a coat carrier hardly falls within the range of 95 to 125°. On the other hand, when m exceeds 10, the resin tends to be precipitated from a solvent. Thus, a good coating film can be hardly obtained at the time of coating. It is preferable that m be in the range of 5 to 9 for combining good release characteristics of toner and the ability of forming a coating film.

More preferably, a resin represented by the following formula (2) is used for attaining excellent adhesiveness to the core.

$$CF_3\text{-}(CF_2)_m(CH_2)_n \tag{2}$$

(In the formula, m represents any integer of 1 to 10 and n represents any integer of 1 to 10.)

Furthermore, a resin having a unit represented by the following formula (3) is preferable.

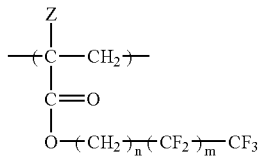

(3)

(In the formula, m and n independently represent an integer of 1 to 10, and z represents a hydrogen atom or a substituted or unsubstituted alkyl group.)

In the above formula (3), z is preferably a methyl group.

Furthermore, a resin having a unit represented by the following formula (4) and a methacrylate unit or acrylate unit represented by the following formula (5) is preferable for the toner separation from the magnetic carrier.

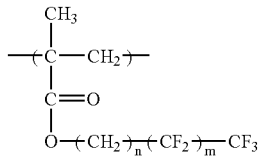

(4)

(In the formula, m and n have the same meaning as the formula (3) above.)

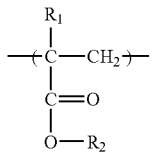

(5)

(In the formula, $R_1$ represents a hydrogen atom or a methyl group, and $R_2$ represents a hydrogen atom or an alkyl group having 1 to 20 carbon atoms.)

Furthermore, a resin obtained by the graft copolymerization of the copolymer units of the above formulas (4) and (5) and a macro monomer such as methyl methacrylate having a molecular weight of 2,000 to 20,000 is particularly preferable to keep the toner-separation characteristics even if the resin is used for a long period of time.

In the case where a thermoplastic resin is used as the fluorine resin for forming a carrier coating material, the thermoplastic resin has a weight average molecular weight of preferably 20,000 to 300,000 in gel permeation chromatography (GPC) of tetrahydrofuran (THF) soluble matter from the viewpoints of enhancing the strength of the coating layer, the adherence between the coating layer and the magnetic core particles, and the adhesion of the thermoplastic resin to the magnetic core particles.

It is preferable that the fluorine resin for forming a coating material have a main peak in the molecular weight range of 2,000 to 100,000 in a chromatogram of GPC of THF soluble matter. It is more preferable that the fluorine resin for forming a coating material have a sub-peak or a shoulder in the molecular weight range of 2,000 to 100,000. It is most preferable that the fluorine resin for forming a coating material have a main peak in the molecular weight range of 20,000 to 100,000 and have a sub-peak or a shoulder in the molecular weight range of 2,000 to 19,000 in the chromatogram of GPC of THF soluble matter. Satisfying the above molecular weight distribution conditions further improves development durability for developing on many sheets even when a toner having a small particle size is used, stability of charging of the toner, and the property of preventing an external additive from adhering to the carrier particle surface.

In addition, in the case where the fluorine resin for forming the coating material is a graft polymer, a backbone of the graft polymer has a weight average molecular weight of preferably 15,000 to 200,000 and a branch of the graft polymer has a weight average molecular weight of preferably 3,000 to 10,000. The weight average molecular weight can be adjusted according to polymerization conditions for a backbone part of the graft polymer and polymerization conditions for a branch part of the graft polymer.

The fluorine resin is preferably a graft copolymer constituted of a unit represented by the formula (1)

(1)

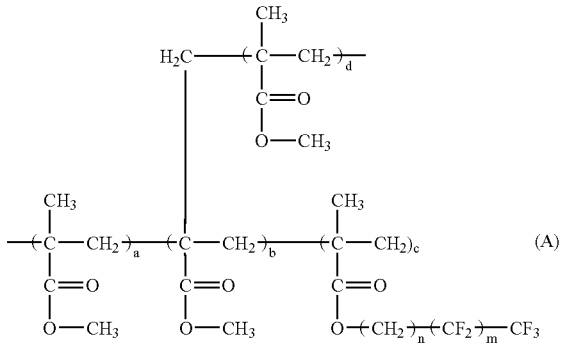

(A)

wherein a, b, c, and d each independently represent an integer of 1 or more; and m and n each independently represent an integer of 1 to 10.

Furthermore, for controlling the irregularity of the surface of the carrier and improving the toner separation, the coating material needs to contain fine particles at a proportion of 1 to 40 parts by weight based on 100 parts by weight of a fluorine resin. The fine particles may be organic or inorganic fine particles, but there is a need to keep the form of particles before coating the carrier. Cross-linking resin particles or inorganic fine particles can be preferably used. Specific examples of the cross-linking resin particles include cross-linking polymethyl methacrylate resin, cross-linking polystyrene resin, melamine resin, phenol resin, and nylon resin. Specific examples of the inorganic fine particles include silica, titanium oxide, and alumina. Those particles can be used independently or in combination. In particular, for improving release characteristics with toner, silica, titanium oxide, alumina, and the like may be used independently or in combination. Furthermore, for obtaining the durability of a coating layer to improve the release characteristics with toner and the electrostatic property of toner for a long period of time, silica obtained by the following sol-gel process is particularly preferable.

The fine particles have a maximum peak value of preferably 80 to 600 nm, more preferably 100 to 500 nm in the particle size distribution on the basis of the number of the fine particles. The use of fine particles having such a maximum peak value forms irregularities on the surface of the magnetic carrier, resulting in excellent toner separation, although the formation depends on the coating amount. Among the fine particles, silica prepared by the sol-gel process is preferable for achieving toner separation and obtaining surface release characteristics for a long period of time because the silica shows an extremely sharp particle size distribution and allows the formation of uniform irregularities. The sol-gel process may be a synthesis process generally used in the art, which provides silica having a uniform particle size by adding water and alcohol to alkoxide provided as a raw material to make a condition referred to as "sol" in which particles are dispersed in a liquid. The silica can be obtained by hydrolysis of the sol to obtain transparent "gel", followed by drying and heating the gel to remove alcohol and water contents therefrom.

Furthermore, the magnetic carrier of the present invention preferably contains 1 to 40 parts by weight of the fine particles based on 100 parts by weight of the fluorine resin, more preferably contains 1 to 15 parts by weight of conductive particles in addition to 1 to 40 parts by weight of the fine particles based on 100 parts by weight of the fluorine resin for preventing an excess decrease in specific resistance of the magnetic carrier and for the removal of the charges remaining on the magnetic carrier.

The conductive particles are preferably particles each having a specific resistance of $1\times10^8$ Ωcm or less, more preferably $1\times10^6$ Ωcm or less. Specifically, the conductive particles preferably contain at least one kind of particle selected from carbon black, magnetite, graphite, titanium oxide, alumina, zinc oxide, and tin oxide. In particular, carbon black can be preferably used as the particles having electrical conductivity because carbon black has a small particle diameter and does not inhibit the irregularity caused by fine particles on the surface of the carrier. The conductive particles preferably have a maximum peak value of 10 nm to 60 nm, more preferably 15 to 50 nm, in the particle size distribution on a number basis. A maximum peak value of the conductive particles in the range of 10 to 60 nm is preferable because the remaining charges on the surface of the carrier can be suitably removed and the separation from the carrier can be suitably prevented.

The amount of a coating material of a resin used for the formation of a coat layer should be in the range of 0.3 to 4.0 parts by weight based on 100 parts by weight of the magnetic material-dispersed resin core for obtaining the effects of surface irregularity formed by fine particles. If the amount is less than 0.3 parts by weight, the fine particles cannot be held, and such a problem as causing the coming-off of the fine particles may occur. If the amount exceeds 4.0 parts by weight, a uniform coating cannot be formed at the time of coating and charge up or the exposure of the core surface may occur and the generation of spent toner may occur on those places. For attaining good toner separation, the amount is preferably in the range of 0.5 to 3.5 parts by weight.

Examples of the magnetic material-dispersed type resin core used in the magnetic carrier of the present invention include magnetic material-dispersed type resin cores (i.e., the so-called resin cores) containing binder resins in which magnetic bodies such as: iron powders having oxidized surfaces or iron powders having unoxidized surfaces; metal particles of iron, lithium, calcium, magnesium, nickel, copper, zinc, cobalt, manganese, chromium, rare earths, and the like and alloy particles and oxide particles thereof; magnetite; and ferrite are dispersed and retained.

Examples of the binder resin include a vinyl resin, a polyester resin, an epoxy resin, a phenol resin, a urea resin, a polyurethane resin, a polyimide resin, a cellulose resin, and a polyether resin each of which has a methylene unit in its polymer chain. Those resins may be mixed before use.

Examples of a vinyl-based monomer for forming a vinyl-based resin include: styrene; styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; unsaturated monoolefins such as ethylene, propylene, butylene, and isobutylene; unsaturated diolefins such as butadiene and isoprene; vinyl halides such as vinyl chloride, vinylidene chloride, vinyl bromide, and vinyl fluoride; vinyl esters such as vinyl acetate, vinyl propionate, and vinyl benzoate; methacrylic acids; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, and phenyl methacrylate; acrylic acids; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; maleic acids and maleic acid half ester; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; acrylate or methacrylate derivatives such as acrylonitrile, methacrylonitrile, and acrylamide; and acrolein. Of those, one or two or more monomers are used for polymerization and the resultant may be used as the vinyl resin.

As a method of producing the magnetic material-dispersed resin core particles, there is a method of producing the magnetic material-dispersed resin core particle by mixing the monomer of the binder resin and the magnetic material to polymerize the monomer. At this time, examples of the monomers to be used for polymerization include, in addition to the above-described vinyl-based monomers: bisphenols and epichlorohydrin for forming epoxy resins; phenols and aldehydes for forming phenol resins; urea and aldehydes for forming urea resins; and melamine and aldehydes for forming melamine resins. An example of a method of producing magnetic material-dispersed type core particles using a curing type phenol resin is a method including: adding magnetic materials to an aqueous medium; and polymerizing phenols and aldehydes in the aqueous medium in the presence of a basic catalyst to produce magnetic material-dispersed type core particles.

Another example of a method of producing magnetic material-dispersed type resin core particles is a method including: sufficiently mixing a vinyl-based or non-vinyl-based thermoplastic resin, a magnetic material, and another additive in a mixer; melting and kneading the mixture by using a kneading machine such as a heating roll, a kneader, or an extruder; cooling the kneaded product; and pulverizing and classifying the kneaded product to produce magnetic material-dispersed type core particles. At this time, it is preferable to thermally or mechanically spheroidize the resultant magnetic material-dispersed type core particles to be used as magnetic material-dispersed type core particles for the resin carriers. Out of the above-described binder resins, thermosetting resins such as a phenol resin, a melamine resin, and an epoxy resin are preferable because of their excellent durability, impact resistance, and heat resistance. A phenol resin is more preferable as a binder resin in order to more suitably express the properties of the present invention.

Magnetic materials are incorporated in resin carriers of the present invention before use. The amount of the magnetic materials to be used in the resin carriers is preferably 70 to 95% by weight (more preferably 80 to 92% by weight) based on the weight of the magnetic carrier for lowering true specific gravity of the magnetic carrier and for ensuring a sufficient mechanical strength. In addition, in order to alter the magnetic properties of the magnetic carrier, it is preferable to compound non-magnetic inorganic compounds in addition to the magnetic materials into the magnetic material-dispersed type core particles. The magnetic materials may preferably have an average particle diameter of 20 to 2,000 nm in the particle size distribution on a number basis.

In addition, for increasing specific resistance values for the magnetic carrier, it is preferable that specific resistance values for the non-magnetic inorganic compounds be greater than those for the magnetic materials and an average particle diameter of the non-magnetic inorganic compounds in a particle size distribution on a number basis be greater than that of the magnetic materials. Specifically, the non-magnetic inorganic compounds may preferably have an average particle diameter of 50 to 5,000 nm in the particle size distribution on a number basis.

The content of the magnetic materials is preferably 50 to 100% by weight based on the total amount of the magnetic materials and the non-magnetic inorganic compounds for adjusting intensities of magnetization of the resin carries to prevent carrier adhesion and for adjusting the specific resistance values for the resin carrier.

Preferably, the magnetic materials in the magnetic carrier to be used in the present invention are fine magnetite particles or fine magnetic ferrite particles each containing at least an iron element or a magnesium element. More preferably, the non-magnetic inorganic compounds are fine hematite ($\alpha$-$Fe_2O_3$) particles for adjusting the magnetic properties and true specific gravity of the carrier.

Examples of phenols for forming phenol resins include in addition to phenol itself: alkylphenols such as m-cresol, p-tert-butylphenol, o-propylphenol, resorcinol, and bisphenol A; and compounds each having a phenolic hydroxyl group such as halogenated phenols in each of which part or whole of a benzene nucleus or of an alkyl group is substituted by a chlorine atom or a bromine atom. Of those, phenol (hydroxybenzene) is more preferable.

Examples of aldehydes include formaldehyde in the form of one of formalin and paraldehyde, and furfural. Of those, formaldehyde is particularly preferable.

A molar ratio of aldehydes to phenols is preferably in the range of 1 to 4, particularly preferably in the range of 1.2 to 3. If the molar ratio of aldehydes to phenols is less than 1, a particle is hardly produced. Even if a particle is produced, resin curing hardly proceeds and thus the strength of a particle to be produced tends to weaken. On the other hand, if the molar ratio of aldehydes to phenols is more than 4, the amount of unreacted aldehydes remaining in an aqueous medium after the reaction tends to increase.

Examples of basic catalysts used in subjecting phenols and aldehydes to condensation polymerization include basic catalysts used for ordinary production of resol type resins. Examples of such basic catalysts include alkylamines such as ammonia water, hexamethylenetetramine, dimethylamine, diethyltriamine, and polyethyleneimine. A molar ratio of those basic catalysts to phenols is preferably in the range of 0.02 to 0.30.

A weight average particle diameter of the toner of the present invention is in the range of 3.0 to 10.0 μm. Furthermore, the weight average particle diameter of the toner is preferably in the range of 4.0 to 7.0 μm for sufficiently satisfying dot reproducibility and transfer efficiency. A weight average particle diameter of the toner of less than 3.0 μm leads to an increase in specific surface area of the toner. As a result, it becomes difficult to uniformly control the charge amount, which may lead to a reduction in developability and an increase in degree of blank areas. A weight average particle diameter of the toner of more than 10.0 μm results in a reduction in dot reproducibility and a high-quality image is hardly obtained. The weight average particle diameter of the toner can be adjusted by classification of toner particles upon production or mixing of classified products etc.

The magnetic carrier and the toner of the present invention can be mixed for use such that their specific surface areas are compatible with each other. The toner concentration used is preferably almost in the range of 4 to 12% by weight for the two-component developer in consideration of the addition of electrification, fogging, image density, prevention of a blank area, and so on. For simultaneously preventing the generation of a blank area, preventing the toner scattering, and improving the transferability, an angle of repose should be in the range of 30 to 41° when the toner concentration in a two-component developer prepared by mixing toner with a magnetic carrier is 8% by weight. The angle of repose of a developer can be suitably adjusted by changing the surface property of the magnetic carrier, the form of toner, the kind of a toner external additive, the amount of the external additive, the particle size of the external additive, and so on.

For satisfying both of transferability and developability, the average circularity of toner used in the present invention is preferably 0.925 or more and 0.980 or less, more preferably 0.925 or more and 0.950 or less. If the average circularity of toner is less than 0.925, the transfer efficiency thereof may worsen. If the average circularity of toner exceeds 0.980, the transfer efficiency will become quite good. In this case, however, the toner will deteriorate gradually as the running proceeds. If the transferability becomes inferior, poor cleaning may tend to occur. The average circularity of toner can be adjusted by a method of manufacturing toner particles or the well-known conglobation treatment method by applying a mechanical force or heat on the toner particles.

A transmittance of light at a wavelength of 600 nm in a dispersion prepared by dispersing the toner of the present invention in a 45% by volume aqueous solution of methanol is preferably in the range of 30 to 80%. Furthermore, the transmittance is more preferably in the range of 40 to 65% for ensuring separation of the toner from the magnetic carriers upon the running and for preventing blank areas.

A binder resin and a release agent are different from each other in wettability. Therefore, in the case where a toner is dispersed in a water-methanol solution, the concentration of the water-methanol solution in which the toner is dispersed differs depending on the difference in release agent existence state near the toner particle surface. In the present invention, by taking advantage of the property, the transmittance is measured and used as an indicator for the release agent existence state near the toner particle surface. In addition, sensitivity to the difference in wettability between the binder resin and the release agent becomes satisfactory when an aqueous solution of methanol the methanol concentration of which is in the vicinity of 45% by volume is used. Therefore, in the present invention, a 45% by volume aqueous solution of methanol (45% by volume of methanol+55% by volume of water) is used.

The light transmittance of the toner in a 45% by volume aqueous solution of methanol may have a large value owing to an increase in toner surface area with decreasing toner particle diameter. In particular, in a toner having such a small particle diameter as a weight average particle diameter of 7.0 μm or smaller, the surface property of the toner surface becomes susceptible to the dispersion state and dispersion particle diameter of a release agent. Therefore, even a slight dispersion failure changes the transmittance to a large extent. The transmittance increases in the case where a large amount of release agent is present near the toner particle surface or in the case where the dispersion state of a release agent is poor and the top of a mass of release agent appears onto the toner particle surface. This is probably because, in each of the above-described cases, toner wettability with respect to the water-methanol solution becomes poor, so that the toner is hardly dispersed.

A transmittance of less than 30% provides a small existing amount of the release agent near the toner particle surface and extremely satisfactory developability after the running as well as extremely small level of blank areas, but may reduce low-temperature-fixability and a gloss. A transmittance of more than 80% provides satisfactory low-temperature-fixability, but causes the toner to be separated from the release agent. The separated toner shifts to the surface of a developing sleeve or of a magnetic carrier to contaminate the surface, so that developability may decrease over the running or many blank areas may be observed.

The transmittance can be adjusted by controlling the release agent existence state on the toner particle surface through control of various conditions including: the temperature and time period for the pulverization and shape adjustment of toner particles upon their production; the kind of release agent to be used; and the kind of dispersant for the release agent. The transmittance can be measured with a spectrophotometer.

Fine particles are externally added to the toner of the present invention before use for improving flowability and transferability, in particular, lowering the level of blank areas while improving the toner separation. An example of external additives to be externally added to the toner particle surface is preferably an inorganic fine particle, which is at least one of a titanium oxide fine particle, an alumina oxide fine particle, and a silica fine particle, and the inorganic fine particles. The inorganic fine particles preferably have a maximum peak value in the particle size distribution on a number basis in the range of 80 to 200 nm in order to allow the inorganic fine particles to function as spacer particles for satisfactorily separating a toner from the carrier. In addition, the external additive is preferably used in combination with fine particles which have a maximum peak value in the particle size distribution on a number basis in a range of 50 nm or less for improving flowability of the toner. As an index thereof, in the present invention, for improving both of toner separation and transferability, the agglomeration degree of toner is preferably in the range of 20 to 90, more preferably 30 to 70, at the time of preparing a developer. If the degree is less than 20, a trouble such as the toner scattering or scattering at the time of transfer tends to occur. If the degree exceeds 90, the toner becomes difficult to be mixed with the magnetic carrier and a problem such as fogging caused by poor electrification tends to occur.

Furthermore, the angle of repose is preferably in the range of 30° to 41°, more preferably 30° to 38°, when the toner concentration in the two-component developer is 8% by weight for attaining good toner separation even after the use for a long period of time and for obtaining an image without any image defect such as a blank area. If the angle of repose is less than 30°, a trouble such as the toner scattering may occur. If the angle of repose exceeds 41°, a trouble such as the generation of a blank area may be caused as a result of poor toner separation from the magnetic carrier. Besides, a trouble in which the developer cannot be transferred to a developing pole as the developer forms a bridge in a developing vessel may also occur.

The toner used in the present invention is preferably toner used for oilless fixation, which contains toner particles each having a binder resin, a colorant, and a release agent, and an external additive. That is, in the preferable toner, the binder resin contains a polyester unit, and the release agent is a hydrocarbon-based wax. In the endothermic curve in the differential thermal analysis of the toner, there are one or two or more endothermic peaks in the temperature range of 30 to 200° C. The preferable toner has the maximum endothermic peak among the endothermic peaks in the temperature range of 65 to 110° C. The toner moderately raises the agglomeration to improve the transferability thereof. In addition, the toner prevents the generation of an image defect such as a blank area. Therefore, the above-mentioned toner can be preferably used.

In the present invention, the term "polyester unit" refers to a part derived from polyester. Examples of polyester-based monomers constituting a polyester unit include a carboxylic acid component such as polycarboxylic acid, polycarboxylic anhydride, or polycarboxylate having two or more carboxyl groups and polyhydric alcohol as a material monomer.

Specific examples of a dihydric alcohol component include: alkylene oxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol; diethylene glycol; triethylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexanedimethanol; dipropylene glycol; polyethylene glycol; polypropylene glycol; polytetramethylene glycol; bisphenol A; and hydrogenated bisphenol A.

Examples of an alcohol component that has three or more hydroxyl groups include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of the carboxylic acid component include: aromatic dicarboxylic acids such as phthalic acid, isophthalic acid, and terephthalic acid, and anhydrides thereof; alkyldicarboxylic acids such as succinic acid, adipic acid, sebacic acid, and azelaic acid, and anhydrides thereof; succinic acids substituted by an alkyl group having 6 to 12 carbon atoms, and anhydrides thereof; and unsaturated dicarboxylic acids such as fumaric acid, maleic acid, and citraconic acid, and anhydrides thereof.

Of those, particularly preferable is the polyester resin obtained by condensation polymerization using, as an alcohol component, a bisphenol derivative represented by the following formula (6) and using, as an acid component, a carboxylic acid component including a divalent or more carboxylic acid, an anhydride thereof, or a lower alkyl ester thereof (such as fumaric acid, maleic acid, maleic anhydride, phthalic acid, terephthalic acid, dodecenyl succinic acid, trimellitic acid, or pyromellitic acid) because the polyester resin exhibits excellent charging property as color toner.

(6)

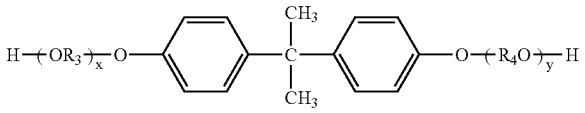

(In the formula, $R_3$ and $R_4$ each independently represent at least one selected from the group consisting of an ethylene group and a propylene group, x and y each represent an integer of 1 or more, in which x+y=2 to 10.)

In addition, examples of polyvalent (at least trivalent) carboxylic acid components for forming a polyester resin having a cross-linked portion include 1,2,4-benzenetricarboxylic acid, 1,2,5-benzentricarboxylic acid, 1,2,4-naphthalenetricarboxylic acid, 2,5,7-naphthalenetricarboxylic acid, 1,2,4,5-benzenetetracarboxylic acid, and acid anhydrides thereof and ester compounds thereof. The amount of polyvalent (at least trivalent) carboxylic acid components used is preferably 0.1 to 1.9 mol % on the basis of the total monomers.

In the present invention, furthermore, it is preferable to use a resin selected from the group consisting of: (a) a polyester resin; (b) a hybrid resin having a polyester unit and a vinyl-based polymer unit; (c) a mixture of a hybrid resin and a vinyl-based polymer; (d) a mixture of a polyester resin and a vinyl-based polymer; (e) a mixture of a hybrid resin and a polyester resin; and (f) a mixture of a polyester resin, a hybrid resin, and a vinyl-based polymer.

Examples of the release agent to be used in the present invention include: aliphatic hydrocarbon-based waxes such as a low molecular weight polyethylene wax, a low molecular weight polypropylene wax, a low molecular weight olefin copolymer, a microcrystalline wax, a paraffin wax, and a Fischer-Tropsch wax; oxides of aliphatic hydrocarbon-based waxes such as a polyethylene oxide wax; waxes mainly composed of fatty esters such as an aliphatic hydrocarbon-based ester wax; and fatty ester waxes such as a deoxidized carnauba wax obtained by deoxidizing part or whole of fatty esters. The examples thereof further include: partially esterified products of fatty acids and polyhydric alcohols such as behenic monoglyceride; and methyl ester compounds having hydroxyl groups obtained through hydrogenation of vegetable fats and oils. Aliphatic hydrocarbon-based waxes such as a paraffin wax, a polyethylene wax, and a Fischer-Tropsch wax are particularly preferably used because of their short molecular chains, little steric hindrance, and excellent mobility.

In an endothermic curve obtained by differential thermal analysis (DSC) measurement, the toner used in the present invention has one endothermic peak or two or more endothermic peaks in the temperature range of 30 to 200° C. The temperature Tsc at the maximum endothermic peak is preferably 65° C.≦Tsc≦110° C., more preferably 70° C.≦Tsc≦90° C. If the temperature at the maximum endothermic peak is less than 65° C., the release agent exudes out of the toner surface and the agglomeration of toner increases. Thus, the generation of a blank area may tend to occur. If the temperature exceeds 110° C., fixing ability may be deteriorated. By the way, the term "maximum endothermic peak" refers to an endothermic peak that takes the maximum value from a base line among endothermic peaks in the region above the endothermic peaks derived from the glass transition temperature of a binder resin. The temperature at the maximum endothermic peak can be adjusted by means of the kind of a release agent used.

The content of the release agent to be used in the present invention is preferably 1 to 10 parts by weight, more preferably 2 to 8 parts by weight based on 100 parts by weight of the binder resin. If the content of the release agent is less than 1 part by weight, releasability may not be exerted well upon oilless fixing, or low temperature fixability may deteriorate. If the content of the release agent exceeds 10 parts by weight, it becomes difficult to control the release agent existence state near the toner particle surface. In addition, a greater number of blank areas may be observed.

The toner of the present invention can be used in combination with a known charge control agent. Examples of such a charge control agent include organometallic complexes, metal salts, and chelate compounds such as monoazo metal complexes, acetylacetone metal complexes, hydroxycarboxylic acid metal complexes, polycarboxylic acid metal complexes, and polyol metal complexes. In addition to the above compounds, the examples thereof include: carboxylic acid derivatives such as carboxylic acid metal salts, carboxylic anhydrides, and esters; and condensates of aromatic compounds. Examples of a charge control agent include phenol derivatives such as bisphenols and calixarenes. In the present invention, aromatic carboxylic acid metal compounds are preferably used to render rising of charge satisfactory.

In the present invention, the charge control agent is preferably in a content of 0.1 to 10 parts by weight, more preferably 0.2 to 5 parts by weight based on 100 parts by weight of the binder resin. A content of charge control agent of less than 0.1 parts by weight may increase variations in charge amount of the toner under environments including a high-temperature and high-humidity environment and a low-temperature and low-humidity environment. A content of charge control agent of more than 10 parts by weight may reduce low temperature fixability of the toner.

Known pigments and dyes may be used alone or in combination as the colorant to be used in the present invention. Examples of the dyes include C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

Examples of the pigments include Mineral Fast Yellow, Navel Yellow, Naphthol Yellow S, Hansa Yellow G, Permanent Yellow NCG, Tartrazine Lake, Molybdenum Orange, Permanent Orange GTR, Pyrazolone Orange, Benzidine Orange G, Permanent Red 4R, Watching Red calcium salt, eosine lake, Brilliant Carmine 3B, Manganese Violet, Fast Violet B, Methyl Violet Lake, Cobalt Blue, Alkali Blue Lake, Victoria Blue Lake, Phthalocyanine Blue, Fast Sky Blue, Indanthrene Blue BC, Chrome Green, Pigment Green B, Malachite Green Lake, and Final Yellow Green G.

Examples of a magenta coloring pigment when used as the toner for forming a full-color image include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, and 238; C.I. Pigment Violet 19; and C.I. Vat Red 1, 2, 10, 13, 15, 23, 29, and 35.

Although each of the pigments may be used alone, it is preferable to use a dye and a pigment in combination to increase the sharpness of a full-color image from the viewpoint of its image quality. Examples of a magenta dye include: oil-soluble dyes such as C.I. Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

Examples of a cyan coloring pigment include: C.I. Pigment Blue 2, 3, 15, 15:1, 15:2, 15:3, 16, and 17; C.I. Acid Blue 6; C.I. Acid Blue 45; and copper phthalocyanine pigments each having a phthalocyanine skeleton to which 1 to 5 phthalimidomethyl groups are added.

Furthermore, examples of a yellow coloring pigment include: C.I. Pigment Yellow 1, 2, 3, 4, 5, 6, 7, 10, 11, 12, 13, 14, 15, 16, 17, 23, 65, 73, 74, 83, 93, 97, 155, and 180; and C.I. Vat Yellow 1, 3, and 20.

Examples of a black pigment include: carbon black such as furnace black, channel black, acetylene black, thermal black or lamp black; or magnetic powder such as magnetite or ferrite.

The amount of the colorant used is preferably 1 to 15 parts by weight, more preferably 3 to 12 parts by weight, still more preferably 4 to 10 parts by weight based on 100 parts by weight of the binder resin. If the content of the colorant is greater than 15 parts by weight, transparency decreases and reproducibility of an intermediate color typified by a human flesh color is liable to decrease. Moreover, the stability of charging performance of toner decreases and it becomes difficult to obtain low temperature fixability. If the content of the colorant is less than 1 part by weight, coloring power decreases, and thus the toner must be used in a large amount in order to achieve the requisite density. In this case, dot reproducibility is easily impaired, making it difficult to obtain a high-quality image with a high image density.

Hereinafter, a description will be given of a preferred measurement methods for physical properties according to the present invention.

<Measurement of Toner Particle or Toner Particle Size Distribution>

Coulter Counter TA-II or Coulter Multisizer II (manufactured by Beckman Coulter, Inc.) is used as a measuring device. An about 1% aqueous solution, of NaCl is used as an electrolyte. An electrolyte prepared by using first-grade sodium chloride or ISOTON(registered trademark)-II (manufactured by Coulter Scientific Japan), for example, can be used as the electrolyte.

A measurement method is as follows. 0.1 to 5 ml of a surfactant (preferably an alkyl benzene sulfonate) is added as a dispersant to 100 to 150 ml of the electrolyte. Then, 2 to 20 mg of measurement sample is added to the electrolyte. The electrolyte in which the sample is suspended is subjected to dispersion treatment in an ultrasonic dispersing unit for about 1 to 3 minutes. After that, by using a 100 μm aperture as an aperture, the volume and number of sample are measured for each channel with the measuring device to calculate the volume and number distributions of the sample. Then, a weight average particle diameter of the sample is determined from the obtained volume and number distributions of the sample. Used as the channels are 13 channels of: 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32 to 40.30 μm.

<Measurement of Average Circularity of Toner>

The average circularity of a toner is measured by using a flow-type particle image measuring device "FPIA-2100" (manufactured by Sysmex Corporation), and is calculated by using the following equations.

$$\text{Circle-equivalent diameter}=(\text{Projected area of a particle}/\Pi)^{1/2}\times 2$$

Circularity=Circumferential length of a circle having the same area as that of the projected area of a particle/Circumferential length of the projected image of a particle where the "projected area of a particle" is defined as an area of a binarized toner particle image, and the "circumferential length of the projected image of a particle" is defined as a length of a borderline drawn by connecting edge points of the toner particle image. The measurement employs the circumferential length of a particle image that has been subjected to image processing in an image processing resolution of 512×512 (pixel measuring 0.3 μm×0.3 μm).

The circularity in the present invention is an indication for the degree of irregularities of a toner particle. If the toner particle is of a complete spherical shape, the circularity is equal to 1.000. The more complicated the surface shape, the lower the value for the circularity.

In addition, the average circularity C which indicates the average value of a circularity frequency distribution is calculated from the following equation when the circularity (center value) of a divisional point i of a particle size distribution is represented by $c_i$ and the number of particles measured is represented by m.

$$\text{Average circularity } C = \sum_{i=1}^{m}(c_i \times f_{ci}) \Big/ \sum_{i=1}^{m}(f_{ci})$$

"FPIA-2100", which is a measuring device to be used in the present invention, calculates the circularities of respective particles. Then, in calculating the average circularity, the measuring device classifies, depending on the obtained circularities, the particles into classes obtained by equally dividing the circularity range of 0.4 to 1.0 in increments of 0.01, and calculates the average circularity by using the center value of a divisional point and the number of particles measured.

A specific measurement method is as follows. 10 ml of ion-exchanged water from which an impurity solid or the like has been removed in advance is charged into a vessel, and a surfactant, preferably an alkyl benzene sulfonate, is added as a dispersant to the water. After that, 0.02 g of a measurement sample is added to the mixture, and is uniformly dispersed. An ultrasonic dispersing unit "Tetora 150" (manufactured by Nikkaki Bios Co., Ltd.) is used as dispersing means, and the dispersion treatment is performed for 2 minutes to prepare a dispersion for measurement. At that time, the dispersion is appropriately cooled so as not to have a temperature of 40° C. or higher. In addition, to suppress circularity variations, the temperature of an environment in which the flow-type particle image measuring device FPIA-2100 is installed is controlled to be 23° C.±0.5° C. in such a manner that the temperature inside the flow-type particle image measuring device is in the range of 26 to 27° C., and an automatic focus adjustment is performed by using a 2-μm latex particle every predetermined time, preferably every 2 hours.

The flow-type particle image measuring device is used to measure circularities of toner particles. The concentration of the dispersion is readjusted in such a manner that the toner particle concentration at the time of the measurement is 3,000 to 10,000 particles/μl, and 1,000 or more toner particles are measured. After the measurement, by using the data, the average circularity of the toner particles is determined while data for particles each having a circle-equivalent diameter of less than 2 μm are discarded.

In addition, "FPIA-2100", which is a measuring device used in the present invention, has higher accuracy of measuring a toner shape than that of "FPIA-1000", which has been conventionally used to calculate a toner shape. This is because, in "FPIA-2100", the magnification of a processed particle image is improved, and the processing resolution for a captured image is improved (changed from 256×256 to 512×512) as compared to "FPIA-1000". The higher accuracy allows "FPIA-2100" to capture fine particles more certainly. Therefore, in the case where a shape must be measured more accurately as in the case of the present invention, FPIA-2100 is more useful than FPIA-1000 because the former can provide information on the shape more accurately.

<Permeability in 45% by Volume Aqueous Solution of Methanol>

(i) Preparation of Toner Dispersion

An aqueous solution with a methanol-to-water volume mixing ratio of 45:55 is prepared. 10 ml of the aqueous solution is charged into a 30 ml sample bottle (Nichiden-Rika Glass Co., Ltd.: SV-30), and 20 mg of toner is immersed into the liquid surface, followed by capping the bottle. After that, the bottle is shaken with a Yayoi shaker (model: YS-LD) at 150 reciprocating motions/min for 5 seconds. At this time, the angle at which the bottle is shaken is set as follows. The direction right above the shaker (vertical direction) is set to 0°, and a shaking support moves forward by 15° and backward by 20°. Then, the bottle is shaken forward once and backward once and returned to the direction right above the shaker. This series of motions is counted as one reciprocating motion.

The sample bottle is fixed to a fixing holder (prepared by fixing the cap of the sample bottle onto an extension line of the center of the support) attached to the tip of the support. After the sample bottle is taken out, a dispersion after 30 seconds of still standing is provided as a dispersion for measurement.

(ii) Transmittance (%) Measurement

The dispersion prepared in (i) is charged into a 1-cm square quartz cell. A transmittance (%) of light at a wavelength of 600 nm in the dispersion is measured by using a spectrophotometer MPS 2000 (manufactured by Shimadzu Corporation) 10 minutes after the cell has been loaded into the spectrophotometer. The transmittance (%) can be determined from the following equation.

$$\text{Transmittance (\%)} = I/I_0 \times 100$$

(In the equation, $I_0$ represents incident luminous flux, and I represents transmitted luminous flux.)

<Measurement of Agglomeration of Toner Particles>

The agglomeration of toner particles is measured by using a Powder Tester P-100 (manufactured by Hosokawa Micron Corp.) according to the following method. Sieves having apertures of 143 μm, 76 μm, and 36 μm are set on a vibrating table from above in this order. 5 g of toner is gently mounted on the sieves and vibrated with a vibration swing width and a vibration time set to 0.5 mm and 15 seconds, respectively. After the vibration is stopped, the weight of toner remaining on each sieve is measured.

$$(\text{Amount of toner remaining on upper sieve}) \div 5\ (\text{g}) \times 100 \qquad a$$

$$(\text{Amount of toner remaining on middle sieve}) \div 5\ (\text{g}) \times 100 \times 0.6 \qquad b$$

$$(\text{Amount of toner remaining on lower sieve}) \div 5\ (\text{g}) \times 100 \times 0.2 \qquad c$$

The sum of a, b, and c is calculated as the agglomeration (%).

<Measurement of Triboelectrification Amount of Toner>

A triboelectrification amount of the toner of the present invention can be measured according to the method described below. First of all, the toner and magnetic carries are mixed in such a manner that the weight of the toner will be 5% by weight to thereby prepare a developer, followed by mixing the developer in a turbler mixer for 120 seconds. Then, the developer is charged into a metal vessel equipped with a 635-mesh (20-μm aperture) conductive screen at its bottom, and is sucked by a suction unit. Then, a difference in weight between the developer before the suction and that after the suction and an electric potential stored in a condenser connected to the vessel are measured. At this time, the suction is performed for 2 minutes and the suction pressure is set to 250 $mmH_2O$. The triboelectrification amount of the toner is calculated from the difference in weight, the stored electric potential, and the capacity of the condenser by using the following equation.

$$Q(\text{mC/kg}) = (C \times V)/(W1 - W2)$$

(In the equation, W1 represents the weight (g) of the developer before the suction, W2 represents the weight (g) of the developer after the suction, C represents the capacity (μF) of the condenser, and V represents the electric potential (V) stored in the condenser.)

<Measurement of Molecular Weight by GPC (Binder Resin of Toner and Resin for Forming Coating Layer of Magnetic Carrier)>

A molecular weight of a chromatogram by gel permeation chromatography (GPC) is measured under the following conditions.

A column is stabilized in a heat chamber at 40° C. Tetrahydrofuran (THF) as a solvent is allowed to flow into the column at the temperature at a flow rate of 1 ml/min. 50 to 200 μl of a THF sample solution of a resin with a sample concentration adjusted to be within the range of 0.05 to 0.6% by weight is injected for measurement. A refractive index (RI) detector is used as a detector. It is recommended that multiple commercially available polystyrene gel columns be combined to be used as the column in order to precisely measure the molecular weight range of $10^3$ to $2\times10^6$. Preferable examples of the combination include; a combination of μ-styragel 500, 103, 104, and 105 (manufactured by Waters Corporation); and a combination of shodex KA-801, 802, 803, 804, 805, 806, and 807 (manufactured by Showa Denko K. K.).

In measuring the molecular weight of a sample, the molecular weight distribution of the sample is calculated from the relationship between a logarithmic value of a calibration curve prepared by several kinds of monodisperse polystyrene standard samples and the number of counts.

Examples of available standard polystyrene samples for preparing a calibration curve include samples manufactured by Pressure Chemical Co. or by Toyo Soda Manufacturing Company, Ltd. having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. At least ten standard polystyrene samples are preferably used.

An available resin for forming a coating layer is prepared by: charging carrier particles into methyl ethyl ketone at a concentration of 10% by weight; subjecting the mixture to dispersion treatment for 2 minutes by using an ultrasonic dispersing unit "Tetora 150" (manufactured by Nikkaki Bios Co., Ltd.); and drying the filtrate prepared by filtering the mixture with a membrane filter having an aperture of 0.2 μm.

<Measurement of Maximum Endothermic Peak of Release agent and Toner>

The maximum endothermic peak of a release agent and toner can be measured using a differential scanning calorimeter (DSC measuring device) DSC2920 (manufactured by TA Instruments Japan) in conformance with ASTM D3418-82.

Temperature curve: Temperature rise I (from 30° C. to 200° C., rate of temperature increase 10° C./min)

Temperature decrease I (from 200° C. to 30° C., rate of temperature decrease 10° C./min)

Temperature rise II (from 30° C. to 200° C., rate of temperature increase 10° C./min)

A measurement method is as follows. 5 to 20 mg, preferably 10 mg of a measurement sample is precisely weighed. The sample is charged into an aluminum pan, and measurement is performed in the measurement temperature range of 30 to 200° C., at a rate of temperature increase of 10° C./min, and under normal temperature and normal humidity by using an empty pan as a reference. The maximum endothermic peak of the toner is determined as follows. In the process of temperature increase II, one having the maximum height from the base line in the range not lower than the endothermic peak at a glass transition temperature (Tg) of a resin is taken as the maximum endothermic peak of the toner of the present invention. Alternatively, in the case where it is difficult to discriminate the endothermic peak at Tg of the resin since it overlaps another endothermic peak, the maximum one of the overlapping peaks is taken as the maximum endothermic peak of the toner of the present invention.

<Measurement of Particle Diameter of Magnetic Carrier>

Particle diameters of magnetic carrier particles are measured as follows. 300 or more magnetic carrier particles each having a particle diameter of 1 μm or more are randomly sampled with a scanning electron microscope (at a magnification of ×2,000). Then, a number average horizontal Feret's diameter of the magnetic carrier particles is determined with a digitizer to be provided as the average particle diameter of the magnetic carriers on a number basis in the particle diameter distribution.

<Measurement of Particle Diameters of Magnetic Materials in Magnetic Carrier>

Particle diameters of magnetic materials are measured as follows. 300 or more particles each having a particle diameter of 5 nm or more are randomly sampled from cross sections obtained by cutting magnetic carriers with a microtome with a scanning electron microscope (at a magnification of ×50,000). Lengths of the major axis and minor axis of each particle are measured with a digitizer, and the average of the lengths is defined as a particle diameter. A particle diameter at which a particle diameter distribution (derived from a histogram of a column with a column width sectioned every 10 nm like 5-15, 15-25, 25-35, 35-45, 45-55, 55-65, 65-75, 75-85, and 85-95) of 300 or more particles shows a peak of the center value for the column is used to calculate the maximum peak value in the particle size distribution in the number distribution.

<Measurement of Particle Diameters of Fine Particles and Non-magnetic Inorganic Compound in Magnetic Carrier>

Particle diameters of fine particles and non-magnetic inorganic compound are measured as follows. 500 or more particles each having a particle diameter of 5 nm or more are randomly sampled from components prepared by dissolving coating materials of magnetic carriers in a solvent such as toluene in which the coating materials are soluble with a scanning electron microscope (at a magnification of ×50,000). Lengths of the major axis and minor axis of each particle are measured with a digitizer, and the average of the lengths is defined as a particle diameter. A particle diameter at which a particle diameter distribution (derived from a histogram of a column with a column width sectioned every 10 nm like 5-15, 15-25, 25-35, 35-45, 45-55, 55-65, 65-75, 75-85, and 85-95) of 500 or more particles shows a peak of the center value for the column is used to calculate the maximum peak value in the particle size distribution in the number distribution.

<Measurement of Particle Diameters of Inorganic Fine Particles of Toner>

Particle diameters of inorganic fine particles (external additive) in the toner surface are measured as follows. 500 or more particles each having a particle diameter of 5 nm or more are randomly sampled with a scanning electron microscope (at a magnification of ×50,000). Lengths of the major axis and minor axis of each particle are measured with a digitizer, and the average of the lengths is defined as a particle diameter. A particle diameter at which a particle diameter distribution (derived from a histogram of a column with a column width sectioned every 10 nm like 5-15, 15-25, 25-35, 35-45, 45-55, 55-65, 65-75, 75-85, and 85-95) of 500 or more particles shows a peak of the center value for the column is used to calculate the maximum peak value in the particle size distribution in the number distribution of the inorganic fine particles.

<Measurement of Intensity of Magnetization of Magnetic Carrier>

The intensity of magnetization of a magnetic carrier can be determined from the magnetic properties and true specific gravity of the magnetic carrier. The magnetic properties of the magnetic carrier can be measured by using a vibration magnetic field-type magnetic property automatic recorder BHV-30 manufactured by Riken Denshi. Co., Ltd. A measurement method is as follows. Magnetic carriers are sufficiently closely packed in a cylindrical plastic container. Meanwhile, an external magnetic field of 79.6 kA/m (1 kOe) is generated. In this state, the magnetizing moment of the magnetic carriers packed in the container is measured. Furthermore, an actual weight of the magnetic carriers packed in the container is measured to determine the intensity of magnetization of the magnetic carriers ($Am^2/kg$).

<Measurement of True Specific Gravity of Magnetic Carrier>

The true specific gravity of a magnetic carrier particle can be determined with a dry type automatic densimeter Auto Pycnometer.

<Measurement of Specific Resistances of Magnetic Carrier, Non-magnetic Inorganic Compound, Magnetic Material and Conductive Fine Particles>

The specific resistance values for a magnetic carrier, non-magnetic inorganic compound, magnetic material and conductive fine particles are measured by using the measuring device shown in FIG. 1. A method to be used for measuring a specific resistance is as follows. Carrier particles are loaded into a cell E, and a lower electrode 11 and an upper electrode 12 are arranged to contact the loaded carrier particles. Then, a voltage is applied between the electrodes, and a current passing at that time is measured. Conditions for measuring a specific resistance in the present invention are as follows. A contact area S between the loaded carrier particles and the electrodes is approximately 2.3 $cm^2$, a thickness d is approximately 0.5 mm, and a load of the upper electrode 12 is 180 g. In FIG. 1, reference numeral 13 denotes an insulator; 14, an ammeter; 15, a voltmeter; 16, a voltage stabilizer; 17, a magnetic carrier; and 18, a guide ring.

<Measurement of Contact Angle of Magnetic Carrier>

A method of measuring a contact angle of a magnetic carrier is as follows. A WTMY-232A wet tester manufactured by Sankyo Pio-Tech Co., Ltd. is used to measure a contact angle with water.

13.2 g of a magnetic carrier is gently loaded into a measuring cell, and a tapping operation is carried out on the cell by using a PTM-1 tapping machine manufactured by Sankyo Pio-Tech Co., Ltd. for 1 minute at a tapping speed of 30 times/min. Then, the cell is set in a measuring device to carry out measurement.

First, the specific surface area of a powder layer is determined according to an air permeation method. Next, a pressure inflection point is determined according to a constant flow rate method. The contact angle of the magnetic carrier is calculated from both of them.

<Measurement of Angle of Repose when Toner Concentration in Developer is 8% by weight>

A developer is prepared as follows. 4 g of toner and 46 g of a magnetic carrier are placed in a 50-ml plastic bottle in such a manner that the toner concentration is 8% by weight. After that, the bottle is shaken with a Yayoi shaker (model: YS-LD) at 150 reciprocating motions/min for 120 seconds. At this time, the angle at which the bottle is shaken is set as follows. The direction right above the shaker (vertical direction) is set to 0°, and a shaking support moves forward by 15° and backward by 20°. Then, the bottle is shaken forward once and backward once and returned to the direction right above the shaker. This series of motions is counted as one reciprocating motion.

The angle of repose of the developer is measured by using a Powder Tester P-100 (manufactured by Hosokawa Micron Corp.) according to the following method. 500 g of the developer is deposited on a circular table of 8 cm in diameter through a mesh having an aperture of 502 μm. At this time, the developer is deposited to such an extent that floods from the end of the table. An angle formed at this time between the edge line of the developer deposited on the table and the circular table surface is measured with laser light and provided as the angle of repose of the developer in the present invention.

Hereinafter, specific examples of the present invention will be described. However, the present invention is not limited to these examples.

PRODUCTION EXAMPLE OF CARRIER CORE A 4.0% by weight and 2.0% by weight of a silane-based coupling agent (3-(2-aminoethylaminopropyl)trimethoxysilane) were added to magnetite fine particles having an average particle diameter of 250 nm in the particle size distribution on a number basis and to hematite fine particles having an average particle diameter of 600 nm in the particle size distribution on a number basis, respectively. The above components were mixed and stirred in a vessel at a high speed at 100° C. or higher, and each fine particle was subjected to lipophilic treatment.

| | |
|---|---|
| Phenol | 10 parts by weight |
| Formaldehyde solution (37% by weight aqueous solution of formaldehyde) | 6 parts by weight |
| Magnetite fine particle as treated above | 59 parts by weight |
| Hematite fine particle as treated above | 25 parts by weight |

The above materials, 5 parts by weight of 28% ammonia water, and 10 parts by weight of water were placed in a flask. The mixture was heated to 85° C. for 30 minutes and held at the temperature while the mixture was stirred and mixed. The mixture was subjected to a polymerization reaction for 3 hours to be cured. After that, the cured mixture was cooled to 30° C., and additional water was added. Then, a supernatant was removed, and a precipitate was washed with water and air-dried. Subsequently, the precipitate was dried at 60° C. under reduced pressure (5 mmHg or less) to produce a magnetic material-dispersed resin core (carrier core A) of a spherical shape having an average particle diameter of 33 μm in the particle size distribution on a number basis in a state where a magnetic material was dispersed.

PRODUCTION EXAMPLE OF CARRIER CORE B 3.0% by weight of a silane-based coupling agent (3-(2-aminoethylaminopropyl)trimethoxysilane) was added to each of magnetite fine particles having an average particle diameter of 300 nm in the particle size distribution on a number basis and hematite fine particles having an average particle diameter of 300 nm in the particle size distribution on a number basis. The above components were mixed and stirred in a vessel at a high speed at 100° C. or higher, and each fine particle was treated.

| | |
|---|---|
| Phenol | 10 parts by weight |
| Formaldehyde solution (37% by weight aqueous solution of formaldehyde) | 6 parts by weight |
| Magnetite fine particle as treated above | 76 parts by weight |
| Hematite fine particle as treated above | 8 parts by weight |

The above materials, 5 parts by weight of 28% ammonia water, and 10 parts by weight of water were placed in a flask.

The mixture was heated to 85° C. for 30 minutes and held at the temperature while the mixture was stirred and mixed. The mixture was subjected to a polymerization reaction for 3 hours to be cured. After that, the cured mixture was cooled to 30° C., and additional water was added. Then, a supernatant was removed, and a precipitate was washed with water and air-dried. Subsequently, the precipitate was dried at 60° C. under reduced pressure (5 mmHg or less) to produce a magnetic material-dispersed resin core (carrier core B) of a spherical shape having an average particle diameter of 32 μm in the particle size distribution on a number basis in a state where a magnetic material was dispersed.

PRODUCTION EXAMPLE OF CARRIER CORE C 2.0% by weight of a titanium-based coupling agent isopropyltri(N-aminoethyl-aminoethyl)titanate was added to magnetite fine particles having an average particle diameter of 0.25 μm in the particle size distribution on a number basis. The above components were mixed and stirred in a vessel at a high speed at 100° C. or higher, and each fine particle was treated.

| | |
|---|---|
| Phenol | 10 parts by weight |
| Formaldehyde solution (37% by weight aqueous solution of formaldehyde) | 6 parts by weight |
| Magnetite fine particle as treated above | 84 parts by weight |

The above materials, 6 parts by weight of 28% ammonia water, and 10 parts by weight of water were placed in a flask. The mixture was heated to 85° C. for 30 minutes and held at the temperature while the mixture was stirred and mixed. The mixture was subjected to a polymerization reaction for 3 hours to be cured. After that, the cured mixture was cooled to 30° C., and additional water was added. Then, a supernatant was removed, and a precipitate was washed with water and air-dried. Subsequently, the precipitate was dried at 60° C. under reduced pressure (5 mmHg or less) to produce a magnetic material-dispersed resin core (carrier core C) of a spherical shape having an average particle diameter of 35 μm in the particle size distribution on a number basis in a state where a magnetic material was dispersed.

PRODUCTION EXAMPLE OF CARRIER CORE D $Fe_2O_3$, CuO, and MgO were weighed in such a manner that molar ratios of $Fe_2O_3$, CuO, and MgO would be 52 mol %, 16 mol %, and 32 mol %, respectively. Then, the above metals were mixed in a ball mill for 10 hours. After the resultant mixture had been calcined at 900° C. for 2 hours, the mixture was pulverized with the ball mill and was then granulated with a spray dryer. The granulated products were sintered at 1150° C. for 10 hours, and then pulverized and classified to produce a magnetic carrier core (carrier core D) of a spherical shape having an average particle diameter of 34 μm in the particle size distribution on a number basis.

COATING RESIN PRODUCTION EXAMPLE 1

100 parts by weight of monomer having the structure represented by the following formula:

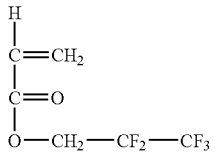

was added to a four-necked flask equipped with a reflux cooler, a thermometer, a nitrogen suction pipe, and a fitting-type stirring device. Furthermore, 100 parts by weight of toluene, 100 parts by weight of methyl ethyl ketone, and 2.0 parts by weight of azobisvaleronitrile were added to the flask. The resultant mixture was held at 70° C. for 10 hours in a stream of nitrogen to yield a solution of a polymer (E) (having a solid content of 33% by weight) having the unit represented by the following formula.

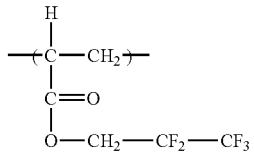

The polymer (E) had a weight average molecular weight of 40,000 by gel permeation chromatography (GPC).

COATING RESIN PRODUCTION EXAMPLE 2

2 parts by weight of methyl methacrylate macromer represented by the following formula and having an ethylenic unsaturated group at one of its terminals and a weight average molecular weight of 5,000;

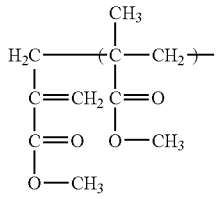

55 parts by weight of monomer having the structure represented by the following formula;

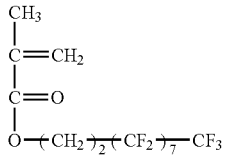

and 43 parts by weight of methyl methacrylate were added to a four-necked flask equipped with a reflux cooler, a thermometer, a nitrogen suction pipe, and a fitting-type stirring device. Furthermore, 90 parts by weight of toluene, 110 parts by weight of methyl ethyl ketone, and 2.0 parts by weight of azobisvaleronitrile were added to the flask. The resultant mixture was held at 70° C. for 10 hours in a stream of nitrogen to yield a solution of a graft copolymer (F) (having a solid content of 33% by weight) having the unit represented by the following formula.

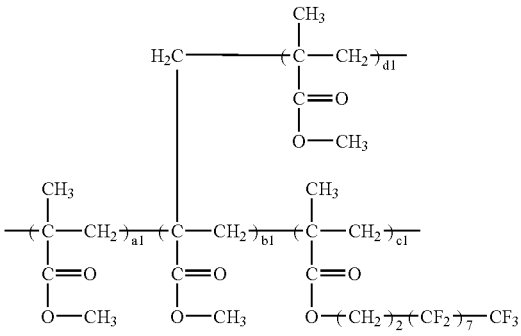

(In the formula, a1, b1, c1, and d1 each independently represent an integer of 1 or more.) The graft copolymer (F) had a weight average molecular weight of 35,000 by gel permeation chromatography (GPC).

COATING RESIN PRODUCTION EXAMPLE 3

5 parts by weight of methyl methacrylate macromer represented by the following formula and having an ethylenic unsaturated group at one of its terminals and a weight average molecular weight of 9,000;

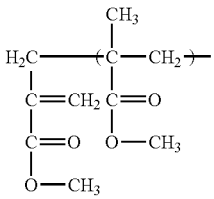

50 parts by weight of monomer having the structure represented by the following formula;

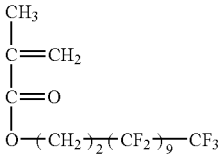

and 45 parts by weight of methyl methacrylate were added to a four-necked flask equipped with a reflux cooler, a thermometer, a nitrogen suction pipe, and a fitting-type stirring device. Furthermore, 90 parts by weight of toluene, 110 parts by weight of methyl ethyl ketone, and 0.7 parts by weight of azobisvaleronitrile were added to the flask. The resultant mixture was held at 70° C. for 10 hours in a stream of nitrogen to yield a solution of a graft copolymer (G) (having a solid content of 33% by weight) having the unit represented by the following formula.

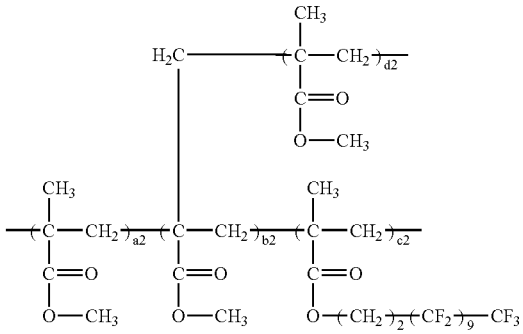

(In the formula, a2, b2, c2, and d2 each independently represent an integer of 1 or more.) The graft copolymer (G) had a weight average molecular weight of 150,000 by gel permeation chromatography (GPC).

COATING RESIN PRODUCTION EXAMPLE 4

2 parts by weight of methyl methacrylate macromer represented by the following formula and having an ethylenic unsaturated group at one of its terminals and a weight average molecular weight of 5,000;

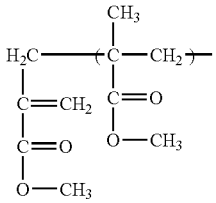

20 parts by weight of monomer having the structure represented by the following formula;

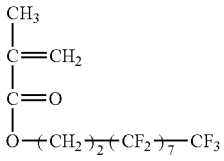

and 78 parts by weight of methyl methacrylate were added to a four-necked flask equipped with a reflux cooler, a thermometer, a nitrogen suction pipe, and a fitting-type stirring device. Furthermore, 90 parts by weight of toluene, 110 parts by weight of methyl ethyl ketone, and 2.0 parts by weight of azobisvaleronitrile were added to the flask. The resultant mixture was held at 70° C. for 10 hours in a stream of nitrogen to yield a solution of a graft copolymer (H) (having a solid content of 33% by weight) having the unit represented by the following formula.

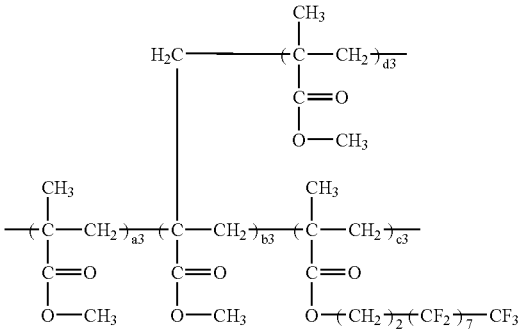

(In the formula, a3, b3, c3, and d3 each independently represent an integer of 1 or more.) The graft copolymer (H) had a weight average molecular weight of 39,000 by gel permeation chromatography (GPC).

TONER PRODUCTION EXAMPLE 1

Placed in a dropping funnel were 2.0 mol of styrene, 0.21 mol of 2-ethylhexyl acrylate, 0.14 mol of fumaric acid, 0.03 mol of a dimer of α-methylstyrene, and 0.05 mol of dicumyl peroxide. Furthermore, placed in a 4 l four-necked flask made of glass were 7.0 mol of polyoxypropylene(2.2)-2,2-bis(4-hydroxyphenyl)propane, 3.0 mol of polyoxyethylene (2.2)-2,2-bis(4-hydroxyphenyl)propane, 3.2 mol of terephthalic acid, 1.8 mol of trimellitic anhydride, 4.9 mol of fumaric acid, and 0.2 g of dibutyltin oxide. A thermometer, a stirring bar, a condenser, and a nitrogen introducing pipe were installed on the four-necked flask, and the four-necked flask was placed in a mantle heater. Subsequently, air in the four-necked flask was substituted by nitrogen gas, and the mixture in the flask was gradually heated while being stirred. Then, a monomer of a vinyl-based polymer unit, a cross-linking agent, and a polymerization initiator were dropped from the dropping funnel over a 4-hour period to the flask while the mixture in the flask was being stirred at 145° C. Next, the mixture in the flask was heated to 200° C., and was reacted for 4 hours to yield a resin X having a weight average molecular weight of 80,000 and a number average molecular weight of 3,200.

| | |
|---|---|
| The above resin X | 100 parts by weight |
| Fischer-Tropsch wax A (having a maximum endothermic peak temperature of 80° C.) | 5 parts by weight |
| Aluminum 3,5-di-t-butylsalicylate compound | 0.5 parts by weight |
| C.I. Pigment Blue 15:3 | 5 parts by weight |

After the above prescribed materials had been mixed in a Henschell Mixer (FM-75, manufactured by Mitsui Miike Kakoki), the mixture was kneaded in a biaxial kneader (PCM-30, manufactured by Ikegai Iron Works) with the temperature preset to 130° C. The resultant kneaded product was cooled and then roughly pulverized with a hammer mill into products each having a size of 1 mm or less. Then, the resultant roughly pulverized toner products were pulverized with a collision type air-jet pulverizer using high pressure gas. The resultant pulverized products were classified by using a multidivisibn classifier based on Coanda effect to obtain cyan particles. Furthermore, the cyan particles were subjected to surface modification in a hybridizer (manufactured by Nara Machinery Co., Ltd.) to obtain cyan particles having a weight average particle diameter of 6.5 μm, an average particle diameter of 5.3 μm in the particle size distribution on a number basis, and an average circularity of 0.935.

Added to 100 parts by weight of the resultant cyan particles were 1.5 parts by weight of silica particles having the maximum peak value at 130 nm in the particle size distribution on a number basis and 0.7 parts by weight of titanium oxide particles having the maximum peak value at 40 nm in the particle size distribution on a number basis. The particles were mixed in a Henschell Mixer (FM-75, manufactured by Mitsui Miike Kakoki) to produce a toner 1. The measured agglomeration of the toner was 43. In addition, a transmittance (%) of the toner 1 in a 45% by volume aqueous solution of methanol was 44%.

TONER PRODUCTION EXAMPLE 2

Placed in a 4-l four-necked flask made of glass were 3.6 mol of polyoxypropylene(2.2)-2,2-bis(4-hydroxyphenyl) propane, 1.6 mol of polyoxyethylene(2.2)-2,2-bis(4-hydroxyphenyl)propane, 1.7 mol of terephthalic acid, 1.2 mol of trimellitic anhydride, 2.4 mol of fumaric acid, and 0.12 g of dibutyltin oxide. A thermometer, a stirring bar, a condenser, and a nitrogen introducing pipe were installed on the four-necked flask, and the four-necked flask was placed in a mantle heater. The mixture in the flask was reacted for 5 hours at 215° C. in a nitrogen atmosphere to yield a resin Y having a weight average molecular weight of 30,000 and a number average molecular weight of 3,800.

| | |
|---|---|
| The above resin Y | 100 parts by weight |
| Aluminum 3,5-di-t-butylsalicylate compound | 0.5 parts by weight |
| C.I. Pigment Blue 15:3 | 5 parts by weight |

The above prescribed materials were treated in the same manner as in Toner Production Example 1 to obtain cyan particles. Furthermore, the cyan particles were subjected to surface modification in a hybridizer (manufactured by Nara Machinery Co., Ltd.) to obtain cyan particles having a weight average particle diameter of 6.6 μm, an average particle diameter of 5.2 μm in the particle size distribution on a number basis, and an average circularity of 0.931.

Added to 100 parts by weight of the resultant cyan particles were 1.5 parts by weight of silica particles having the maximum peak value at 90 nm in the particle size distribution on a number basis and 0.8 parts by weight of titanium oxide particles having the maximum peak value at 50 nm in the particle size distribution on a number basis. The particles were mixed in a Henschell Mixer (FM-75, manufactured by Mitsui Miike Kakoki) to produce a toner 2. The measured agglomeration of the toner was 31. In addition, a transmittance (%) of the toner 2 in a 45% by volume aqueous solution of methanol was 64%.

TONER PRODUCTION EXAMPLE 3

| | |
|---|---|
| Styrene | 85 parts by weight |
| n-butyl acrylate | 15 parts by weight |
| Acrylic acid | 3 parts by weight |

-continued

| | |
|---|---|
| Dodecanethiol | 6 parts by weight |
| Carbon tetrabromide | 1 part by weight |

The above prescribed materials were mixed and dissolved. The resultant solution was dispersed and emulsified into a solution of 1.5 parts by weight of a nonionic surfactant (manufactured by Sanyo Chemical Industries, Ltd., Nonipol 400) and 2.5 parts by weight of an anionic surfactant (manufactured by Dai-ichi Kogyo Seiyaku Co., Ltd., Neogen S.C.) in 140 parts by weight of ion-exchanged water in a flask, and the whole was slowly mixed for 10 minutes. During the mixing, a solution of 1 part by weight of ammonium persulfate in 10 parts by weight of ion-exchanged water was added to the mixture. After air in the flask had been substituted by nitrogen, the flask was heated in an oil bath while the content in the flask was stirred until the temperature of the content in the flask reached 70° C. In this state, emulsion polymerization was continued for 5 hours. As a result, a dispersion 1 of resin particles having an average particle diameter of 0.15 μm in the particle size distribution on a number basis (hereinafter, referred to as "resin particle dispersion 1") was prepared.

| | |
|---|---|
| Styrene | 75 parts by weight |
| n-butyl acrylate | 25 parts by weight |
| Acrylic acid | 2 parts by weight |

In addition, the above prescribed materials were mixed and dissolved. The resultant solution was dispersed and emulsified into a solution of 1.5 parts by weight of a nonionic surfactant (manufactured by Sanyo Chemical Industries, Ltd., Nonipol 400) and 3 parts by weight of an anionic surfactant (manufactured by Dai-ichi Kogyo Seiyaku Co., Ltd., Neogen S.C.) in 150 parts by weight of ion-exchanged water in a flask, and the whole was slowly mixed for 10 minutes. During the mixing, a solution of 0.8 parts by weight of ammonium persulfate in 10 parts by weight of ion-exchanged water was added to the mixture. After air in the flask had been substituted by nitrogen, the flask was heated in an oil bath while the content in the flask was stirred until the temperature of the content in the flask reached 70° C. In this state, emulsion polymerization was continued for 5 hours. As a result, a dispersion 2 of resin particles having an average particle diameter of 0.11 μm in the particle size distribution on a number basis (hereinafter, referred to as "resin particle dispersion 2") was prepared.

| | |
|---|---|
| Paraffin wax (having a melting point of 95° C.) | 50 parts by weight |
| Anionic surfactant (manufactured by Dai-ichi Kogyo Seiyaku Co., Ltd., Neogen SC) | 5 parts by weight |
| Ion-exchanged water | 200 parts by weight |

Furthermore, the above prescribed materials were heated to 97° C. and dispersed by using a homogenizer (manufactured by IKA, Ultratarax T50). After that, the resultant was subjected to dispersion treatment in a pressure discharge-type homogenizer to prepare a dispersion of release agent particles in which a release agent having an average particle diameter of 0.4 μm in the particle size distribution on a number basis is dispersed (hereinafter, referred to as "release agent dispersion").

| | |
|---|---|
| C.I. Pigment Blue 15:3 | 12 parts by weight |
| Anionic surfactant (manufactured by Dai-ichi Kogyo Seiyaku Co., Ltd., Neogen SC) | 2 parts by weight |
| Ion-exchanged water | 78 parts by weight |

Furthermore, the above prescribed materials were mixed and then dispersed by using a sand grinder mill to prepare a colorant dispersion.

| | |
|---|---|
| The above resin particle dispersion 1 | 150 parts by weight |
| The above resin particle dispersion 2 | 210 parts by weight |
| The above colorant dispersion | 40 parts by weight |
| The above release agent dispersion | 70 parts by weight |

Furthermore, the above dispersions were placed and stirred in a 1 liter stainless separable flask equipped with a stirring device, a cooling pipe, and a thermometer. The pH of the mixed solution was adjusted to 5.2 by using 1N potassium hydroxide.

150 parts by weight of a 10% aqueous solution of sodium chloride was dropped as a coagulant to the mixed solution, and the whole was heated to 70° C. while being stirred in the flask in an oil bath for heating. At the temperature, 3 parts by weight of the resin particle dispersion 2 was added to the mixture. After the mixture had been held at 60° C. for 1 hour, 3 parts by weight of an anionic surfactant (manufactured by Dai-ichi Kogyo Seiyaku Co., Ltd., Neogen S.C.) was added to the mixture. Then, the stainless flask was sealed, heated to 90° C. while the stirring was continued by using a magnetic force seal, and held at the temperature for 3 hours. After the flask had been cooled, the reaction product was filtered, sufficiently washed with ion-exchanged water, and dried to obtain cyan particles having a weight average particle diameter of 6.0 μm, an average particle diameter of 5.1 μm in the particle size distribution on a number basis, and an average circularity of 0.970.

Added to 100 parts by weight of the resultant cyan particles were 1.8 parts by weight of silica particles having the maximum peak value at 130 nm in the particle size distribution on a number basis and 0.8 parts by weight of titanium particles having the maximum peak value at 50 nm in the particle size distribution on a number basis. The particles were mixed in a Henschell Mixer (FM-75, manufactured by Mitsui Miike Kakoki) to produce a toner 3. The measured agglomeration of the toner was 64. In addition, a transmittance (%) of the toner 3 in a 45% by volume aqueous solution of methanol was 55%.

EXAMPLE 1

Sufficiently mixed with 30 parts by weight of a solution of the graft copolymer (E) in a homogenizer were 0.5 parts by weight of titanium oxide particles obtained by sol-gel process and having the maximum peak value at 140 nm in the particle size distribution on a number basis and 100 parts by weight of toluene. Then, 2,000 parts by weight of the carrier core A was stirred while shearing stress was continuously applied to the carrier core. During the stirring, the above coating liquid was gradually added to the carrier core, and the solvent was volatilized at 70° C. to coat the carrier surface with a resin. The resin-coated magnetic carrier particles were subjected to heat treatment while being stirred at 100° C. for 2 hours. After having been cooled, the particles were cracked and classified with a sieve having an aperture of 76 μm to obtain a magnetic carrier having an average particle diameter of 33 μm in the particle size distribution on a number basis, a true specific gravity of 3.59 g/cm$^3$, an intensity of magnetization of 39 Am$^2$/kg, a specific resistance of $8\times10^{12}$ Ω·cm, and a contact angle of 101°. Furthermore, 10 g (precisely measured) of the magnetic carrier was loaded into 30 g of methyl ethyl ketone in a plastic cup, and the whole was subjected to dispersion treatment for 5 minutes by using an ultrasonic dispersing unit "Tetora 150" (manufactured by Nikkaki Bios Co., Ltd.). After that, a magnet was attached to the back surface of the bottom of the plastic cup to trap the carrier. Then, a supernatant was transferred to another plastic cup, and the remaining carrier core was dried with a vacuum drier. A coating amount (total amount) was calculated by subtracting the amount of the dried core from the amount of the loaded carrier. The supernatant was filtered with a membrane filter having an aperture of 0.20 μm, and the filtrate was dried to calculate the resin amount. Particles on the membrane filter were used to measure a particle diameter. Table 1 lists the results. The same procedure is adopted by the following examples.

10 parts by weight of the toner 1 was added to 90 parts by weight of the carrier, and the whole was mixed in a turbler mixer to prepare a developer. The measured triboelectrification amount of the developer was −29.4 mC/kg, and the angle of repose of the developer when the toner concentration was 8% by weight was 38°.

Image output evaluation was carried out under normal temperature and normal humidity (23° C., 60% RH) by using the developer and a modified apparatus of a full-color copier CLC 5000 manufactured by Canon Inc. (a device obtained by subjecting CLC 5000 to modifications including: narrowing a laser spot size; enabling CLC 5000 to output an image at 600 dpi; replacing the surface layer of a fixing roller in a fixing unit with a PFA tube; and removing an oil application mechanism). The development conditions were as follows. The developing sleeve and the photosensitive member were rotated in the forward direction in the development area, the developing sleeve was rotated 1.85 times as fast as the photosensitive member, and Vd, Vl, Vdc, Vpp, and the frequency were set to −600 V, −110 V, −450 V, 2 kV, and 1.8 kHz, respectively. The items and criteria of the image output evaluation are shown below.

(1) Dot Reproducibility

A 30H image was formed by means of the toner and the modified apparatus. Then, the image was visually observed and evaluated for dot reproducibility on the basis of the following criteria. The value "30H" of the 30H image, which is a halftone image, is obtained by expressing 256 levels of gray in hexadecimal numbers and setting 00H and FFH to solid white and solid black, respectively.

A: The image provides no roughness and is smooth.

B: The image provides limited roughness.

C: The image provides some degree of roughness, which is not problematic in practical use.

D: The image provides roughness, which becomes a problem.

E: The image provides extremely high degree of roughness.

(2) Image Density

Measured was an image density of a fixed image when the solid image was fixed at 180° C.

(3) Image Defect Evaluation

Outputted was a chart in which a halftone lateral band (30H, 10 mm in width) and a solid black lateral band (FFH, 10 mm in width) were alternately arranged in the transporting direction of transfer paper. The image was read with a scanner and subjected to binarizing processing. The brightness distribution (256 levels of gray) of a line in the transporting direction of the binarized image was picked up, and the tangent was drawn to the halftone brightness at that time. The brightness area (area: the sum of brightness levels) deviating from the tangent at the rear end of a halftone part until the tangent intersected the brightness of a solid part was defined as the degree of blank area.

A: The degree of blank area is 50 or less. Nearly no blank areas are conspicuous, which is extremely good.

B: The degree of blank area is in the range of 51 to 150, which is good.

C: The degree of blank area is in the range of 151 to 300. Some blank areas are observed, which is not problematic in practical use.

D: The degree of blank area is in the range of 301 to 600. Blank areas are conspicuous, which becomes a problem.

E: The degree of blank area is 601 or more. Blank areas are extremely conspicuous.

In this embodiment, the dot reproducibility in the 30H image was extremely good. In addition, the image density was high. Although some blank areas were observed, the degree of blank area was at a practically acceptable level.

Furthermore, a 10,000-sheet running test by a 3% chart was performed. The toner was evaluated for triboelectrification amount, dot reproducibility, image density, and degree of blank area in the same manners as those described above at an initial stage of the running test and after the running test. As a result, no variation in charge amount due to carrier spent or the like was observed, and no variation in degree of blank area was observed. In other words, no practical problems arose. In addition, a high-quality image with no fogging was obtained. Table 1 shows the physical properties of the carrier particles and Table 2 shows the test results of the developer.

EXAMPLE 2

Sufficiently mixed with 60 parts by weight of a solution of the graft copolymer (E) in a homogenizer were 1 part by weight of silica particles obtained by sol-gel process and having the maximum peak value at 320 nm in the particle size distribution on a number basis, 1 part by weight of carbon black having the maximum peak value at 35 nm in the particle size distribution on a number basis, and 200 parts by weight of toluene. Then, 2,000 parts by weight of the carrier core A was stirred while shearing stress was continuously applied to the carrier core. During the stirring, the above coating liquid was gradually added to the carrier core, and the solvent was volatilized at 70° C. to coat the carrier surface with a resin. The resin-coated magnetic carrier particles were subjected to heat treatment while being stirred at 100° C. for 2 hours. After having been cooled, the particles were cracked and classified with a sieve having an aperture of 76 μm to obtain a magnetic carrier having an average particle diameter of 33 μm in the particle size distribution on a number basis, a true specific gravity of 3.57 g/cm$^3$, an intensity of magnetization of 39 Am$^2$/kg, a specific resistance of $7\times10^{12}$ Ω·cm, and a contact angle of 102°.

10 parts by weight of the toner 1 was added to 90 parts by weight of the carrier to prepare a developer in the same manner as in Example 1. The measured triboelectrification amount of the developer was −32.1 mC/kg, and the angle of repose of the developer when the toner concentration was 8% by weight was 37°.

The developer was tested in the same manner as in Example 1. As a result, the degree of blank area decreased as compared to Example 1. Table 1 shows the physical properties of the carrier particles and Table 2 shows the test results of the developer.

EXAMPLE 3

Sufficiently mixed with 60 parts by weight of a solution of the graft copolymer (F) in a homogenizer were 3 parts by weight of silica particles obtained by sol-gel process and having the maximum peak value at 290 nm in the particle size distribution on a number basis, 2 parts by weight of carbon black having the maximum peak value at 35 nm in the particle size distribution on a number basis, and 200 parts by weight of toluene. Then, 2,000 parts by weight of the carrier core A was stirred while shearing stress was continuously applied to the carrier core. During the stirring, the above coating liquid was gradually added to the carrier core, and the solvent was volatilized at 70° C. to coat the carrier surface with a resin. The resin-coated magnetic carrier particles were subjected to heat treatment while being stirred at 100° C. for 2 hours. After having been cooled, the particles were cracked and classified with a sieve having an aperture of 76 μm to obtain a magnetic carrier having an average particle diameter of 33 μm in the particle size distribution on a number basis, a true specific gravity of 3.55 g/cm$^3$, an intensity of magnetization of 38 Am$^2$/kg, a specific resistance of $4\times10^{12}$ Ω·cm, and a contact angle of 120°.

10 parts by weight of the toner 1 was added to 90 parts by weight of the carrier to prepare a developer in the same manner as in Example 1. The measured triboelectrification amount of the developer was −31.5 mC/kg, and the angle of repose of the developer when the toner concentration was 8% by weight was 32°.

The developer was tested in the same manner as in Example 1. As a result, no blank areas were observed, the image density was high, and good developability was obtained. In addition, nearly no deterioration of the toner or of the carrier during the running was observed, and thus good results were obtained. Table 1 shows the physical properties of the carrier particles and Table 2 shows the test results of the developer.

EXAMPLE 4

Sufficiently mixed with 210 parts by weight of a solution of the graft copolymer (F) in a homogenizer were 7 parts by weight of titanium oxide particles obtained by sol-gel process and having the maximum peak value at 140 nm in the particle size distribution on a number basis, 7 parts by weight of carbon black having the maximum peak value at 14 nm in the particle size distribution on a number basis, and 500 parts by weight of toluene. Then, 2,000 parts by weight of the carrier core A was placed in a fluidized layer coating apparatus, and the above coating liquid was sprayed on the carrier core A to coat the carrier surface with a resin at 70° C. The resin-coated magnetic carrier particles were subjected to heat treatment at 100° C. for 2 hours while a fluidized layer was formed. While the fluidized layer was maintained, the particles were cooled, and then taken out. Then, the particles were cracked and classified with a sieve having an aperture of 76 μm to obtain a magnetic carrier having an average particle diameter of 35 μm in the particle size distribution on a number basis, a true specific gravity of 3.54 g/cm$^3$, an intensity of magnetization of 38 Am$^2$/kg, a specific resistance of $5\times10^{14}$ Ω·cm, and a contact angle of 110°.

10 parts by weight of the toner 1 was added to 90 parts by weight of the carrier to prepare a developer in the same manner as in Example 1. The measured triboelectrification amount of the developer was −43.0 mC/kg, and the angle of repose of the developer when the toner concentration was 8% by weight was 35°.

The developer was tested in the same manner as in Example 1. As a result, the degree of blank area was low and, in particular, the roughness was mitigated. In addition, the characteristics after the running were good. Table 1 shows the physical properties of the carrier particles and Table 2 shows the test results of the developer.

EXAMPLE 5

Sufficiently mixed with 60 parts by weight of a solution of the graft copolymer (G) in a homogenizer were 2 parts by weight of titanium oxide particles obtained by sol-gel process and having the maximum peak value at 140 nm in the particle size distribution on a number basis, 6 parts by weight of tin oxide (Pastolan 4310, available from Mitsui Kinzoku) having the maximum peak value at 103 nm in the particle size distribution on a number basis, and 200 parts by weight of toluene. Then, 2,000 parts by weight of the carrier core A was stirred while shearing stress was continuously applied to the carrier core A. During the stirring, the above coating liquid was gradually added to the carrier core A to coat the carrier surface in the same manner as in Example 1, resulting in a magnetic carrier having an average particle diameter of 33 μm in the particle size distribution on a number basis, a true specific gravity of 3.59 g/cm$^3$, an intensity of magnetization of 38 Am$^2$/kg, a specific resistance of $9\times10^{12}$ Ω·cm, and a contact angle of 105°.

10 parts by weight of the toner 1 was added to 90 parts by weight of the carrier to prepare a developer in the same manner as in Example 1. The measured triboelectrification amount of the developer was −30.3 mC/kg, and the angle of repose of the developer when the toner concentration was 8% by weight was 37°.

The developer was tested in the same manner as in Example 1. As a result, the degree of blank area, the roughness, and the like were mitigated. The running test resulted in a slightly higher degree of blank area, which was not a practical problem. The observation of the carrier revealed that part of the carrier surface was not evenly coated with the coating material. Table 1 shows the physical properties of the carrier particles and Table 2 shows the test results of the developer.

EXAMPLE 6

Sufficiently mixed with 90 parts by weight of a solution of the graft copolymer (F) in a homogenizer were 4.5 parts by weight of silica particles obtained by sol-gel process and having the maximum peak value at 290 nm in the particle size distribution on a number basis, 3 parts by weight of carbon black having the maximum peak value at 29 nm in the particle size distribution on a number basis, and 200 parts by weight of toluene. Then, 2,000 parts by weight of the carrier core B instead of the carrier core A was stirred while shearing stress was continuously applied to the carrier core B. During the stirring, the above coating liquid was gradually added to the carrier core B, and the solvent was volatilized at 70° C. to coat the carrier surface with a resin. The resin-coated magnetic carrier particles were subjected to heat treatment while being stirred at 100° C. for 2 hours. After having been cooled, the particles were cracked and classified with a sieve having an aperture of 76 μm to obtain a magnetic carrier having an average particle diameter of 32 μm in the particle size distribution on a number basis, a true specific gravity of 3.60 g/cm$^3$, an intensity of magnetization of 49 Am$^2$/kg, a specific resistance of $4\times10^{11}$ Ω·cm, and a contact angle of 115°.

10 parts by weight of the toner 1 was added to 90 parts by weight of the carrier to prepare a developer in the same manner as in Example 1. The measured triboelectrification amount of the developer was −34.4 mC/kg, and the angle of repose of the developer when the toner concentration was 8% by weight was 34°.

The developer was tested in the same manner as in Example 1. As a result, no blank areas were observed, the image density was high, and good developability was obtained. Although the running resulted in a slight variation in image quality, the degree of blank area, the roughness, and the like were at practically acceptable levels. Table 1 shows the physical properties of the carrier particles and Table 2 shows the test results of the developer.

EXAMPLE 7

Sufficiently mixed with 90 parts by weight of a solution of the graft copolymer (F) in a homogenizer were 3 parts by weight of cross-linked polymethyl methacrylate particles obtained by soap-free emulsion polymerization and having the maximum peak value at 220 nm in the particle size distribution on a number basis, 3 parts by weight of carbon black having the maximum peak value at 29 nm in the particle size distribution on a number basis, and 200 parts by weight of toluene. Then, 2,000 parts by weight of the carrier core C instead of the carrier core A was stirred while shearing stress was continuously applied to the carrier core C. During the stirring, the above coating liquid was gradually added to the carrier core C to coat the carrier surface with a resin in the same manner as in Example 1, resulting in a magnetic carrier having an average particle diameter of 35 μm in the particle size distribution on a number basis, a true specific gravity of 3.62 g/cm$^3$, an intensity of magnetization of 61 Am$^2$/kg, a specific resistance of $7\times10^{10}$ Ω·cm, and a contact angle of 107°.

10 parts by weight of the toner 1 was added to 90 parts by weight of the carrier to prepare a developer in the same manner as in Example 1. The measured triboelectrification amount of the developer was −36.0 mC/kg, and the angle of repose of the developer when the toner concentration was 8% by weight was 36°.

The developer was tested in the same manner as in Example 1. As a result, the degree of blank area was mitigated. Although the running resulted in slight variations in roughness and degree of blank area, the roughness and the degree of blank area were at practically acceptable levels. Table 1 shows the physical properties of the carrier particles and Table 2 shows the test results of the developer.

EXAMPLE 8

A toner 1' (having an agglomeration of 35 and a transmittance (%) of 53% in a 45% by volume aqueous solution of methanol) was produced in the same manner as that of the toner 1 except that no silica particle was added and the amount of titanium oxide particles to be mixed in a Henschell Mixer was changed to 1.0 part by weight. 10 parts by weight of the toner was added to 90 parts by weight of the carrier used in Example 2 to prepare a developer in the same manner as in Example 1. The measured triboelectrification amount of the developer was −28.8 mC/kg, and the angle of repose of the developer when the toner concentration was 8% by weight was 38°.

The developer was tested in the same manner as in Example 1. Table 1 shows the physical properties of the carrier particles and Table 2 shows the test results of the developer.

EXAMPLE 9

10 parts by weight of the toner 2 was added to 90 parts by weight of the carrier used in Example 2 to prepare a developer in the same manner as in Example 1. The measured triboelectrification amount of the developer was −27.0 mC/kg, and the angle of repose of the developer when the toner concentration was 8% by weight was 35°.

Image output evaluation was carried out under normal temperature and normal humidity (23° C., 60% RH) by using the developer and a full-color copier CLC 5000 manufactured by Canon. The development conditions were as follows. A contrast potential and a fogging removal potential were set to 340 V and 150 V, respectively. The developer was tested in the same manner as in Example 1. As a result, a good image was obtained. Table 1 shows the physical properties of the carrier particles and Table 2 shows the test results of the developer.

EXAMPLE 10

9 parts by weight of the toner 3 was added to 91 parts by weight of the carrier used in Example 2 to prepare a developer in the same manner as in Example 1. The measured triboelectrification amount of the developer was −31.3 mC/kg, and the angle of repose of the developer when the toner concentration was 8% by weight was 36°.

The developer was tested in the same manner as in Example 1. As a result, a good image excellent in transferability was obtained. Table 1 shows the physical properties of the carrier particles and Table 2 shows the test results of the developer.

EXAMPLE 11

Magenta particles (having a weight average particle diameter of 6.2 μm, an average particle diameter of 5.2 μm in the particle size distribution on a number basis, an average circularity of 0.951, and an agglomeration of 45) were obtained in the same manner as in Example 1 except that the pigment used in the toner 1 was changed to 4 parts by weight of C.I. Pigment Red 122 and 2 parts by weight of C.I. Pigment Red 57. In addition, yellow particles (having a weight average particle diameter of 6.5 μm, an average particle diameter of 5.3 μm in the particle size distribution on a number basis, an average circularity of 0.955, and an agglomeration of 41) were obtained in the same manner as in Example 1 except that the pigment used in the toner 1 was changed to 6 parts by weight of C.I. Pigment Yellow 74. Furthermore, black particles (having a weight average particle diameter of 6.6 μm, an average particle diameter of 5.3 μm in the particle size distribution on a number basis, an average circularity of 0.952, and an agglomeration of 40) were obtained in the same manner as in Example 1 except that the pigment used in the toner 1 was changed to 5 parts by weight of carbon black.

Those toners, the cyan toner used in Example 1, and the carrier used in Example 3 were mixed to prepare a developer having the toner concentration of 10% by weight in the same manner as in Example 1. The measured triboelectrification amounts of the magenta, cyan, yellow, and black toners were −30.7 mC/kg, −31.5 mC/kg, −33.0 mC/kg, and −30.5 mC/kg, respectively.

A full-color chart was printed out by means of the developer and the modified apparatus of a full-color copier CLC 5000 manufactured by Canon, the modified apparatus having been used in Example 1. As a result, an extremely good image was obtained, which was excellent in dot reproducibility and exhibited no edge effect particularly in a secondary color (a part obtained by superimposing two or more kinds of toners).

Table 1 shows the physical properties of the carrier particles.

COMPARATIVE EXAMPLE 1

Sufficiently mixed with 30 parts by weight of a solution of the graft copolymer (E) in a homogenizer were 0.5 parts by weight of silica particles obtained by sol-gel process and having the maximum peak value at 320 nm in the particle size distribution on a number basis and 100 parts by weight of toluene. Then, 2,000 parts by weight of the carrier core D instead of the carrier core A was stirred while shearing stress was continuously applied to the carrier core D. During the stirring, the above coating liquid was gradually added to the carrier core D, and the solvent was volatilized at 70° C. to coat the carrier surface with a resin. The resin-coated magnetic carrier particles were subjected to heat treatment while being stirred at 100° C. for 2 hours. After having been cooled, the particles were cracked and classified with a sieve having an aperture of 76 μm to obtain a magnetic carrier having an average particle diameter of 35 μm in the particle size distribution on a number basis, a true specific gravity of 5.04 g/cm$^3$, an intensity of magnetization of 60 Am$^2$/kg, a specific resistance of $5\times10^8$ Ω·cm, and a contact angle of 103°.

7 parts by weight of the toner 1 was added to 93 parts by weight of the carrier to prepare a developer in the same manner as in Example 1. The measured triboelectrification amount of the developer was −28.4 mC/kg, and the angle of repose of the developer when the toner concentration was 8% by weight was 37°.

The developer was tested in the same manner as in Example 1. As a result, the degree of blank area was low, but the roughness was high. In addition, after the running, carrier spent was observed, the degree of blank area slightly increased, and the roughness also increased. Table 1 shows the physical properties of the carrier particles and Table 2 shows the test results of the developer.

COMPARATIVE EXAMPLE 2

Mixed were 100 parts by weight of a silicone resin (SR2411 manufactured by Toray Dow Silicone Co., Ltd., 10% by weight in solid content), 3 parts by weight of γ-aminopropyltrimethoxysilane, and 200 parts by weight of toluene. Then, 1,000 parts by weight of the carrier core A was stirred while shearing stress was continuously applied to the carrier core A. During the stirring, the above coating liquid was gradually added to the carrier core A, and the solvent was volatilized at 70° C. to coat the carrier surface with a resin. The resin-coated magnetic carrier particles were subjected to heat treatment while being stirred at 200° C. for 1 hour. After having been cooled, the particles were cracked and classified with a sieve having an aperture of 76 μm to obtain a magnetic carrier having an average particle diameter of 34 μm in the particle size distribution on a number basis, a true specific gravity of 3.55 g/cm$^3$, an intensity of magnetization of 38 Am$^2$/kg, a specific resistance of $5\times10^{13}$ Ω·cm, and a contact angle of 100°.

10 parts by weight of the toner 1 was added to 90 parts by weight of the magnetic carrier to prepare a developer in the same manner as in Example 1. The measured triboelectrification amount of the developer was −30.2 mC/kg, and the angle of repose of the developer when the toner concentration was 8% by weight was 38°.

The developer was tested in the same manner as in Example 1. As a result, the roughness was low, but the degree of blank area was high. Table 1 shows the physical properties of the magnetic carrier and Table 2 shows the test results of the developer.

COMPARATIVE EXAMPLE 3

Resin coating was performed in the same manner as in Example 3 except that the graft copolymer (F) was replaced by the graft copolymer (H), thereby resulting in a magnetic carrier having an average particle diameter of 33 μm in the particle size distribution on a number basis, a true specific gravity of 3.54 g/cm$^3$, an intensity of magnetization of 38 Am$^2$/kg, a specific resistance of $6\times10^{12}$ Ω·cm, and a contact angle of 94°.

10 parts by weight of the toner 1 was added to 90 parts by weight of the carrier to prepare a developer in the same manner as in Example 1. The measured triboelectrification amount of the developer was −34.4 mC/kg, and the angle of repose of the developer when the toner concentration was 8% by weight was 42°.

The developer was tested in the same manner as in Example 1. As a result, the dot reproducibility was excellent, but the degree of blank area was high, the image density was low, and the developability was poor. In addition, the deterioration of the carrier during the running was observed, and the degree of blank area further increased. Table 1 shows the physical properties of the carrier particles and Table 2 shows the test results of the developer.

TABLE 1

| | Carrier core | Coating resin | Coating amount (% by weight) | Fine particle | Maximum peak value (nm) | Addition amount (% by weight) | Conductive particle | Maximum peak value (nm) | Addition amount (% by weight) | Average particle diameter (μm) | True specific gravity (g/cm$^3$) | Intensity of magnetization | Specific resistance (Ωcm) | Contact angle (°) |
|---|---|---|---|---|---|---|---|---|---|---|---|---|---|---|
| Ex. 1 | A | E | 0.51 | Titanium oxide | 140 | 4.9 | — | — | — | 33 | 3.59 | 39 | $8\times10^{12}$ | 101 |
| Ex. 2 | A | E | 1.02 | Silica | 320 | 5.0 | Carbon | 40 | 4.9 | 33 | 3.57 | 39 | $7\times10^{12}$ | 102 |

TABLE 1-continued

| | Carrier core | Coating resin | Coating amount (% by weight) | Fine particle | Maximum peak value (nm) | Addition amount (% by weight) | Conductive particle | Maximum peak value (nm) | Addition amount (% by weight) | Average particle diameter (μm) | True specific gravity (g/cm$^3$) | Intensity of magnetization | Specific resistance (Ωcm) | Contact angle (°) |
|---|---|---|---|---|---|---|---|---|---|---|---|---|---|---|
| Ex. 3 | A | F | 0.99 | Silica | 290 | 14.8 | Carbon | 40 | 9.8 | 33 | 3.55 | 38 | $4 \times 10^{12}$ | 120 |
| Ex. 4 | A | F | 3.51 | Titanium oxide | 140 | 10.1 | Carbon | 20 | 10.3 | 35 | 3.54 | 38 | $5 \times 10^{14}$ | 110 |
| Ex. 5 | A | G | 0.98 | Titanium oxide | 140 | 9.6 | $SnO_2$ | 100 | 19.9 | 33 | 3.59 | 38 | $9 \times 10^{12}$ | 105 |
| Ex. 6 | B | F | 1.48 | Silica | 290 | 14.5 | Carbon | 30 | 9.9 | 32 | 3.60 | 49 | $4 \times 10^{11}$ | 115 |
| Ex. 7 | C | F | 1.50 | PMMA | 220 | 9.7 | Carbon | 30 | 9.8 | 35 | 3.62 | 61 | $7 \times 10^{10}$ | 107 |
| Ex. 8 | | | | | | | Same as Example 2 | | | | | | | |
| Ex. 9 | | | | | | | Same as Example 2 | | | | | | | |
| Ex. 10 | | | | | | | Same as Example 2 | | | | | | | |
| Co. Ex. 1 | D | E | 0.49 | Silica | 320 | 4.8 | — | — | — | 35 | 5.04 | 60 | $5 \times 10^{8}$ | 103 |
| Co. Ex. 2 | A | Silicone | 1.00 | — | — | — | — | — | — | 34 | 3.55 | 38 | $5 \times 10^{13}$ | 100 |
| Co. Ex. 3 | A | H | 0.99 | Silica | 290 | 14.8 | carbon | 40 | 9.7 | 33 | 3.54 | 38 | $6 \times 10^{12}$ | 92 |
| Ex. 11 | | | | | | | Same as Example 3 | | | | | | | |

The addition amount of fine particles or conductive particles is the amount based 100 parts by weight of coating resin solid content.

The coating resin coating amount of Comparative Example 2 is the loaded amount.

TABLE 2

| | Toner | Toner average circularity | Toner concentration (% by weight) | Initial stage | | | | | After running | | | | |
|---|---|---|---|---|---|---|---|---|---|---|---|---|---|
| | | | | Triboelectrification amount | Angle of repose (°) | Image density | Dot reproducibility | Degree of blank area | Triboelectrification amount | Angle of repose (°) | Image density | Dot reproducibility | Degree of blank area |
| Ex. 1 | 1 | 0.935 | 10 | −29.4 | 38 | 1.55 | B | C | −32.1 | 40 | 1.49 | C | C |
| Ex. 2 | 1 | 0.935 | 10 | −32.1 | 37 | 1.51 | B | B | −33.6 | 39 | 1.47 | B | C |
| Ex. 3 | 1 | 0.935 | 10 | −31.5 | 32 | 1.60 | A | A | −32.2 | 33 | 1.60 | A | A |
| Ex. 4 | 1 | 0.935 | 10 | −43.0 | 35 | 1.50 | A | B | −45.4 | 37 | 1.45 | A | C |
| Ex. 5 | 1 | 0.935 | 10 | −30.3 | 37 | 1.52 | B | B | −33.3 | 39 | 1.46 | B | C |
| Ex. 6 | 1 | 0.935 | 10 | −34.4 | 34 | 1.55 | B | A | −35.9 | 37 | 1.52 | B | B |
| Ex. 7 | 1 | 0.935 | 10 | −36.0 | 36 | 1.54 | B | A | −39.7 | 39 | 1.48 | C | B |
| Ex. 8 | 1' | 0.935 | 10 | −28.8 | 38 | 1.50 | B | B | −33.2 | 41 | 1.43 | C | C |
| Ex. 9 | 2 | 0.931 | 10 | −27.0 | 35 | 1.59 | B | B | −30.6 | 39 | 1.52 | C | C |
| Ex. 10 | 3 | 0.970 | 9 | −31.3 | 36 | 1.57 | B | B | −33.4 | 37 | 1.55 | B | B |
| Co. Ex. 1 | 1 | 0.935 | 7 | −28.4 | 37 | 1.58 | D | A | −35.9 | 43 | 1.43 | E | B |
| Co. Ex. 2 | 1 | 0.935 | 10 | −30.2 | 38 | 1.53 | A | D | −34.7 | 42 | 1.47 | B | E |
| Co. Ex. 3 | 1 | 0.935 | 10 | −34.4 | 42 | 1.32 | B | E | −38.8 | 46 | 1.20 | C | E |

What is claimed is:

1. A magnetic carrier comprising carrier particles, wherein each carrier particle comprises a carrier core and a coating material for coating the carrier core, the carrier core comprises a binder resin and magnetic particles dispersed in the binder resin, the coating material comprises at least 100 parts by weight of a fluorine resin and 1 to 40 parts by weight of fine particles, said fluorine resin being a graft copolymer constituted of a unit represented by the formula (A)

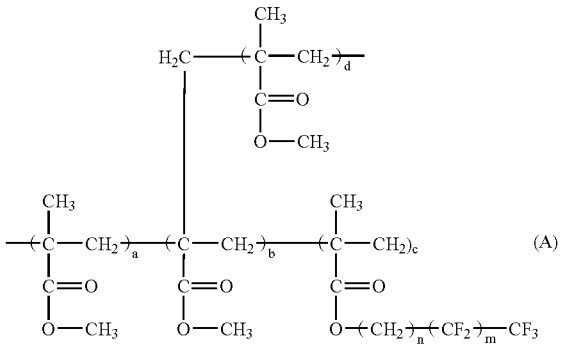

(A)

wherein a, b, c, and d each independently represent an integer of 1 or more: and m and n each independently represent an integer of 1 to 10, the carrier comprises at least 100 parts by weight of the carrier core and 0.3 to 4.0 parts by weight of the coating material, and a contact angle of the magnetic carrier is 95 to 125°.

2. A magnetic carrier according to claim 1, wherein the magnetic cattier has a true specific gravity of 2.5 to 4.0 g/cm$^3$.

3. A magnetic carrier according to claim 1, wherein the magnetic carrier has an intensity of magnetization ($\delta_{10000}$) of 15 to 65 Am$^2$/kg (emu/g) when measured at a magnetic field of 1000×(10$^3$/4Π)·A/m (1,000 Oe).

4. A magnetic carrier according to claim 1, wherein the fine particles have a maximum peak value of 80 to 600 nm in a particle size distribution on a number basis.

5. A magnetic carrier according to claim 1, wherein the fine particles comprise silica particles.

6. A magnetic carrier according to claim 1, wherein the carrier particles comprises at least 100 parts by weight of the carrier core and 0.5 to 4.0 parts by weight of the coating material.

7. A magnetic carrier according to claim 1, wherein m in the formula (A) is 9 or 10.

8. A two-component developer, comprising a toner and a magnetic carrier, wherein the toner comprises at least toner particles and an external additive, the toner particles contain at least a binder resin, a release agent, and a colorant, and an agglomeration of the toner is 20 to 90, the magnetic carrier comprises carrier particles, each carrier particle comprises a carrier core and a coating material for coating the carrier core, the carrier core comprises a binder resin and magnetic particles dispersed in the binder resin, the coating material comprises at least 100 parts by weight of a fluorine resin and 1 to 40 parts by weight of fine particles, said fluorine resin being a graft copolymer constituted of a unit represented by the formula (A)

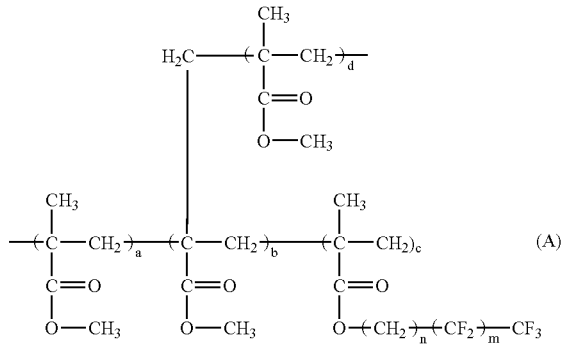

(A)

wherein a, b, c, and d each independently represent an integer of 1 or more; and m and n each independently represent an integer of 1 to 10, the carrier comprises at least 100 parts by weight of the carrier core and 0.3 to 4.0 parts by weight of the coating material, and a contact angle of the magnetic carrier is 95 to 125°.

9. A two-component developer according to claim 8, wherein m in the formula (A) is 9 or 10.

10. A two-component developer according to claim 8, wherein the two-component developer has an angle of repose of 30 to 41° when a toner concentration is 8% by weight.

11. A two-component developer according to claim 8, wherein the external additive comprises inorganic fine particles, and the inorganic fine particles have a maximum peak value of 80 to 200 nm in a particle size distribution on a number basis.

12. A two-component developer comprising a toner and a magnetic carrier, wherein the toner comprises at least toner particles and an external additive, the toner particles contain at least a binder resin, a release agent, and a colorant, and an agglomeration of the toner is 20 to 90, the magnetic carrier comprises carrier particles, each carrier particle comprises a carrier core and a coating material for coating the carrier core, the carrier core comprises a binder resin and magnetic particles dispersed in the binder resin, the coating material comprises at least 100 parts by weight of a fluorine resin and 1 to 40 parts by weight of fine particles, said fluorine resin being a graft copolymer constituted of a unit represented by the formula (A)

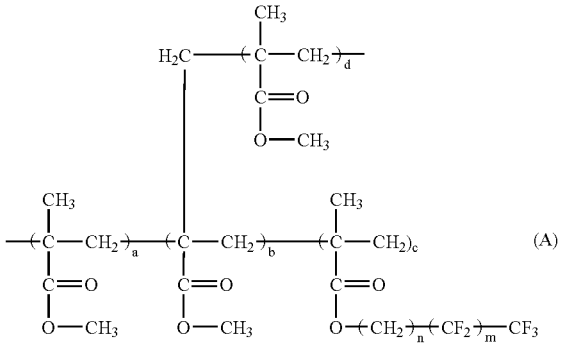

(A)

wherein a, b, c, and d each independently represent an integer of 1 or more; and m and n each independently represent an integer of 1 to 10, the carrier comprises at least 100 parts by weight of the carrier core and 0.3 to 4.0 parts by weight of the coating material, and a contact angle of the magnetic carrier is 95 to 125° and wherein the magnetic carrier comprises the magnetic carrier according to any one of claims 2 to 6.

13. A two-component developer according to claim 12, wherein m in the formula (A) is 9 or 10.

* * * * *

UNITED STATES PATENT AND TRADEMARK OFFICE

CERTIFICATE OF CORRECTION

PATENT NO. : 7,244,539 B2
APPLICATION NO. : 10/834073
DATED : July 17, 2007
INVENTOR(S) : Yoshinobu Baba et al.

It is certified that error appears in the above-identified patent and that said Letters Patent is hereby corrected as shown below:

COLUMN 1:

Line 48, “carriers,” should read --carriers--; and
Line 52, “printing,” should read --printing--.

COLUMN 2:

Line 15, “amount” should read --the amount--;
Line 17, “tend” should read --tends--;
Line 25, “have solved” should read --solves--;
Line 28, “two-component developer,” should read --a two-component developer--;
Line 29, “allow” should read --allows--;
Line 35, “two-component developer,” should read --a two-component developer--; and
Line 36, “allow” should read --allows--.

COLUMN 3:

Line 6, “two-component developer, which allow” should read --a two-component developer which allows--; and
Line 20, “carrier” should read --carriers--.

COLUMN 9:

Line 48, “tite;” should read --tite--; and
Line 52, “resin” should read --resin,--.

COLUMN 11:

Line 16, “carries” should read --carriers--.

COLUMN 17:

Line 11, “28.” should read --and 28.--;
Line 40, “a” should be deleted; and
Line 47, “solution,” should read --solution--.

UNITED STATES PATENT AND TRADEMARK OFFICE

CERTIFICATE OF CORRECTION

PATENT NO. : 7,244,539 B2
APPLICATION NO. : 10/834073
DATED : July 17, 2007
INVENTOR(S) : Yoshinobu Baba et al.

It is certified that error appears in the above-identified patent and that said Letters Patent is hereby corrected as shown below:

COLUMN 20:

Line 19, “carries” should read --carriers--;
Line 26, “that” should read --the weight--; and
Line 58, “include;” should read --include:--.

COLUMN 21:

Line 54, “number” should read --number of--.

COLUMN 22:

Line 15, “compound” should read --compounds--.

COLUMN 23:

Line 65, “floods” should read --it floods--.

COLUMN 24:

Line 26, “particle” should read --particles--;
Line 27, “particle” should read --particles--;
Line 62, “particle” should read --particles--; and
Line 63, “particle” should read --particles--.

COLUMN 25:

Line 30, “particle” should read --particles--.

COLUMN 26:

Line 51, “formula;” should read --formula:--.

COLUMN 27:

Line 50, “formula;” should read --formula:--.

UNITED STATES PATENT AND TRADEMARK OFFICE

CERTIFICATE OF CORRECTION

PATENT NO. : 7,244,539 B2
APPLICATION NO. : 10/834073
DATED : July 17, 2007
INVENTOR(S) : Yoshinobu Baba et al.

It is certified that error appears in the above-identified patent and that said Letters Patent is hereby corrected as shown below:

COLUMN 28:

Line 46, “formula;” should read --formula:--

COLUMN 29:

Line 27, “4 1” should read --4-1--; and
Line 55, “above prescribed” should read --above-prescribed--.

COLUMN 30:

Line 39, “above prescribed” should read --above-prescribed--.

COLUMN 31:

Line 6, “above prescribed” should read --above-prescribed--;
Line 12, “S.C.)” should read --SC--;
Line 32, “above prescribed” should read --above-prescribed--;
Line 38, “S.C.)” should read --SC--; and
Line 59, “above prescribed” should read --above-prescribed--.

COLUMN 32:

Line 8, “above prescribed” should read --above-prescribed--; and
Line 30, “S.C.)” should read --SC--.

COLUMN 33:

Line 18, “fillered” should read --filtered--.

UNITED STATES PATENT AND TRADEMARK OFFICE

CERTIFICATE OF CORRECTION

PATENT NO. : 7,244,539 B2
APPLICATION NO. : 10/834073
DATED : July 17, 2007
INVENTOR(S) : Yoshinobu Baba et al.

It is certified that error appears in the above-identified patent and that said Letters Patent is hereby corrected as shown below:

COLUMN 43:

Line 37, "cattier" should read --carrier--;
Line 40, "($\delta_{10000}$)" should read --($\sigma_{1000}$)--; and
Line 50, "comprises" should read --comprise--.

Signed and Sealed this

Fifteenth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,244,539 B2
APPLICATION NO. : 10/834073
DATED : July 17, 2007
INVENTOR(S) : Yoshinobu Baba et al.

It is certified that error appears in the above-identified patent and that said Letters Patent is hereby corrected as shown below:

On the cover page, item

[*] Notice: Subject to any disclaimer, the term of this patent is extended or adjusted under 35 USC 154(b) by 321 days Delete the phrase "by 321 days" and insert --by 374 days--

COLUMN 1:

Line 48, "carriers," should read --carriers--; and
Line 52, "printing," should read --printing--.

COLUMN 2:

Line 15, "amount" should read --the amount--;
Line 17, "tend" should read --tends--;
Line 25, "have solved" should read --solves--;
Line 28, "two-component developer," should read --a two-component developer--;

Line 29, "allow" should read --allows--;
Line 35, "two-component developer," should read --a two-component developer--; and
Line 36, "allow" should read --allows--.

COLUMN 3:

Line 6, "two-component developer, which allow" should read --a two-component developer which allows--; and
Line 20, "carrier" should read --carriers--.

COLUMN 9:

Line 48, "tite;" should read --tite--; and
Line 52, "resin" should read --resin,--.

UNITED STATES PATENT AND TRADEMARK OFFICE

CERTIFICATE OF CORRECTION

PATENT NO. : 7,244,539 B2
APPLICATION NO. : 10/834073
DATED : July 17, 2007
INVENTOR(S) : Yoshinobu Baba et al.

It is certified that error appears in the above-identified patent and that said Letters Patent is hereby corrected as shown below:

COLUMN 11:

Line 16, “carries” should read --carriers--.

COLUMN 17:

Line 11, “28.” should read --and 28.--;
Line 40, “a” should be deleted; and
Line 47, “solution,” should read --solution--.

COLUMN 20:

Line 19, “carries” should read --carriers--;
Line 26, “that” should read --the weight--; and
Line 58, “include;” should read --include:--.

COLUMN 21:

Line 54, “number” should read --number of--.

COLUMN 22:

Line 15, “compound” should read --compounds--.

COLUMN 23:

Line 65, “floods” should read --it floods--.

COLUMN 24:

Line 26, “particle” should read --particles--;
Line 27, “particle” should read --particles--;
Line 62, “particle” should read --particles--; and
Line 63, “particle” should read --particles--.

UNITED STATES PATENT AND TRADEMARK OFFICE

CERTIFICATE OF CORRECTION

PATENT NO. : 7,244,539 B2
APPLICATION NO. : 10/834073
DATED : July 17, 2007
INVENTOR(S) : Yoshinobu Baba et al.

It is certified that error appears in the above-identified patent and that said Letters Patent is hereby corrected as shown below:

COLUMN 25:

Line 30, “particle” should read --particles--.

COLUMN 26:

Line 51, “formula;” should read --formula:--.

COLUMN 27:

Line 50, “formula;” should read --formula:--.

COLUMN 28:

Line 46, “formula;” should read --formula:--.

COLUMN 29:

Line 27, “4 1” should read --4-1--; and
Line 55, “above prescribed” should read --above-prescribed--.

COLUMN 30:

Line 39, “above prescribed” should read --above-prescribed--.

COLUMN 31:

Line 6, “above prescribed” should read --above-prescribed--;
Line 12, “S.C.)” should read --SC--;
Line 32, “above prescribed” should read --above-prescribed--;
Line 38, “S.C.)” should read --SC--; and
Line 59, “above prescribed” should read --above-prescribed--.

COLUMN 32:

Line 8, “above prescribed” should read --above-prescribed--; and
Line 30, “S.C.)” should read --SC--.

UNITED STATES PATENT AND TRADEMARK OFFICE

CERTIFICATE OF CORRECTION

PATENT NO. : 7,244,539 B2
APPLICATION NO. : 10/834073
DATED : July 17, 2007
INVENTOR(S) : Yoshinobu Baba et al.

It is certified that error appears in the above-identified patent and that said Letters Patent is hereby corrected as shown below:

COLUMN 33:

Line 18, "fillered" should read --filtered--.

COLUMN 43:

Line 37, "cattier" should read --carrier--;
Line 40, "($\delta_{10000}$)" should read --($\sigma_{1000}$)--; and
Line 50, "comprises" should read --comprise--.

Signed and Sealed this

Twenty-ninth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,244,539 B2
APPLICATION NO. : 10/834073
DATED : July 17, 2007
INVENTOR(S) : Baba et al.

It is certified that error appears in the above-identified patent and that said Letters Patent is hereby corrected as shown below:

On the title page,

[*] Notice: Subject to any disclaimer, the term of this patent is extended or adjusted under 35 USC 154(b) by 321 days Delete the phrase "by 321 days" and insert -- by 374 days --

Signed and Sealed this

Seventh Day of October, 2008

JON W. DUDAS
*Director of the United States Patent and Trademark Office*